US010926532B2

(12) United States Patent
Chechik et al.

(10) Patent No.: US 10,926,532 B2
(45) Date of Patent: Feb. 23, 2021

(54) ENDLESS FLEXIBLE BELT FOR A PRINTING SYSTEM

(71) Applicant: LANDA CORPORATION LTD., Rehovot (IL)

(72) Inventors: Helena Chechik, Rehovot (IL); Shoham Livaderu, Moshav Sitriyya (IL)

(73) Assignee: LANDA CORPORATION LTD., Rehovot (IL)

( * ) Notice: Subject to any disclaimer, the term of this patent is extended or adjusted under 35 U.S.C. 154(b) by 0 days.

(21) Appl. No.: 16/649,177

(22) PCT Filed: Oct. 16, 2018

(86) PCT No.: PCT/IB2018/058009

§ 371 (c)(1),
(2) Date: Mar. 20, 2020

(87) PCT Pub. No.: WO2019/077489

PCT Pub. Date: Apr. 25, 2019

(65) Prior Publication Data

US 2020/0290340 A1 Sep. 17, 2020

Related U.S. Application Data

(60) Provisional application No. 62/574,275, filed on Oct. 19, 2017.

(51) Int. Cl.

| | |
|---|---|
| ***B41J 2/01*** | (2006.01) |
| ***B41J 11/00*** | (2006.01) |
| ***B41J 29/38*** | (2006.01) |

(52) U.S. Cl.

CPC ..... *B41J 2/01* (2013.01); *B41J 11/007* (2013.01); *B41J 11/0055* (2013.01); *B41J 29/38* (2013.01); *B41J 2002/012* (2013.01)

(58) Field of Classification Search

CPC ..... B41J 2002/012; B41J 11/007; B41J 2/01; B41J 11/0055

(Continued)

(56) References Cited

U.S. PATENT DOCUMENTS 2,839,181 A 6/1958 Renner
3,011,545 A 12/1961 Welsh et al.

(Continued)

FOREIGN PATENT DOCUMENTS

CN 1121033 A 4/1996
CN 1200085 A 11/1998

(Continued)

OTHER PUBLICATIONS

"Amino Functional Silicone Polymers", in Xiameter.COPYRGT. 2009 Dow Corning Corporation.

(Continued)

*Primary Examiner* — An H Do
(74) *Attorney, Agent, or Firm* — Momentum IP; Marc Van Dyke

(57) ABSTRACT

An intermediate transfer member (ITM) for use in a printing system. The ITM includes an endless flexible belt formed of an elongate belt having a longitudinal axis. Attached to lateral edges of the endless flexible belt along the longitudinal axis are a first elongate strip and a second elongate strip, each of the elongate strips including lateral formations on outward facing lateral ends thereof which are distal to the lateral edges of the belt. At least one of the first and second elongate strips includes a first longitudinal portion having a first elasticity, and a second longitudinal portion having a second elasticity, such that the second elasticity is greater than the first elasticity. The first portion is attached to the lateral edges of the flexible belt and the second portion extends between the first portion and the lateral formations.

20 Claims, 4 Drawing Sheets

(58) Field of Classification Search
USPC ..... 347/101–104
See application file for complete search history.

(56) References Cited

U.S. PATENT DOCUMENTS

| | | | |
|---|---|---|---|
| 3,053,319 | A | 9/1962 | Cronin et al. |
| 3,697,551 | A | 10/1972 | Thomson |
| 3,697,568 | A | 10/1972 | Boissieras et al. |
| 3,889,802 | A | 6/1975 | Jonkers |
| 3,898,670 | A | 8/1975 | Erikson et al. |
| 3,947,113 | A | 3/1976 | Buchan et al. |
| 4,009,958 | A | 3/1977 | Kurita et al. |
| 4,093,764 | A | 6/1978 | Duckett et al. |
| 4,293,866 | A | 10/1981 | Takita et al. |
| 4,401,500 | A | 8/1983 | Hamada et al. |
| 4,535,694 | A | 8/1985 | Fukuda |
| 4,538,156 | A | 8/1985 | Durkee et al. |
| 4,555,437 | A | 11/1985 | Tanck |
| 4,575,465 | A | 3/1986 | Viola |
| 4,642,654 | A | 2/1987 | Toganoh et al. |
| 4,853,737 | A | 8/1989 | Hartley et al. |
| 4,976,197 | A | 12/1990 | Yamanari et al. |
| 5,012,072 | A | 4/1991 | Martin et al. |
| 5,039,339 | A | 8/1991 | Phan et al. |
| 5,062,364 | A | 11/1991 | Lewis et al. |
| 5,075,731 | A | 12/1991 | Kamimura et al. |
| 5,099,256 | A | 3/1992 | Anderson |
| 5,106,417 | A | 4/1992 | Hauser et al. |
| 5,128,091 | A | 7/1992 | Agur et al. |
| 5,190,582 | A | 3/1993 | Shinozuka et al. |
| 5,198,835 | A | 3/1993 | Ando et al. |
| 5,246,100 | A | 9/1993 | Stone et al. |
| 5,264,904 | A | 11/1993 | Audi et al. |
| 5,305,099 | A | 4/1994 | Morcos |
| 5,333,771 | A | 8/1994 | Cesario |
| 5,349,905 | A | 9/1994 | Taylor et al. |
| 5,352,507 | A | 10/1994 | Bresson et al. |
| 5,365,324 | A | 11/1994 | Gu et al. |
| 5,406,884 | A | 4/1995 | Okuda et al. |
| 5,471,233 | A | 11/1995 | Okamoto et al. |
| 5,532,314 | A | 7/1996 | Sexsmith |
| 5,552,875 | A | 9/1996 | Sagiv et al. |
| 5,575,873 | A | 11/1996 | Pieper et al. |
| 5,587,779 | A | 12/1996 | Heeren et al. |
| 5,608,004 | A | 3/1997 | Toyoda et al. |
| 5,613,669 | A | 3/1997 | Grueninger |
| 5,614,933 | A | 3/1997 | Hindman et al. |
| 5,623,296 | A | 4/1997 | Fujino et al. |
| 5,642,141 | A | 6/1997 | Hale et al. |
| 5,660,108 | A | 8/1997 | Pensavecchia |
| 5,677,719 | A | 10/1997 | Granzow |
| 5,679,463 | A | 10/1997 | Visser et al. |
| 5,698,018 | A | 12/1997 | Bishop et al. |
| 5,723,242 | A | 3/1998 | Woo et al. |
| 5,733,698 | A | 3/1998 | Lehman et al. |
| 5,736,250 | A | 4/1998 | Heeks et al. |
| 5,772,746 | A | 6/1998 | Sawada et al. |
| 5,777,576 | A | 7/1998 | Zur et al. |
| 5,777,650 | A | 7/1998 | Blank |
| 5,841,456 | A | 11/1998 | Takei et al. |
| 5,859,076 | A | 1/1999 | Kozma et al. |
| 5,880,214 | A | 3/1999 | Okuda |
| 5,883,144 | A | 3/1999 | Bambara et al. |
| 5,883,145 | A | 3/1999 | Hurley et al. |
| 5,884,559 | A | 3/1999 | Okubo et al. |
| 5,889,534 | A | 3/1999 | Johnson et al. |
| 5,891,934 | A | 4/1999 | Moffatt et al. |
| 5,895,711 | A | 4/1999 | Yamaki et al. |
| 5,902,841 | A | 5/1999 | Jaeger et al. |
| 5,923,929 | A | 7/1999 | Ben Avraham et al. |
| 5,929,129 | A | 7/1999 | Feichtinger |
| 5,932,659 | A | 8/1999 | Bambara et al. |
| 5,935,751 | A | 8/1999 | Matsuoka et al. |
| 5,978,631 | A | 11/1999 | Lee |
| 5,978,638 | A | 11/1999 | Tanaka et al. |
| 5,991,590 | A | 11/1999 | Chang et al. |
| 6,004,647 | A | 12/1999 | Bambara et al. |
| 6,009,284 | A | 12/1999 | Weinberger et al. |
| 6,024,018 | A | 2/2000 | Darel et al. |
| 6,024,786 | A | 2/2000 | Gore |
| 6,033,049 | A | 3/2000 | Fukuda |
| 6,045,817 | A | 4/2000 | Ananthapadmanabhan et al. |
| 6,053,438 | A | 4/2000 | Romano, Jr. et al. |
| 6,055,396 | A | 4/2000 | Pang |
| 6,059,407 | A | 5/2000 | Komatsu et al. |
| 6,071,368 | A | 6/2000 | Boyd et al. |
| 6,072,976 | A | 6/2000 | Kuriyama et al. |
| 6,078,775 | A | 6/2000 | Arai et al. |
| 6,094,558 | A | 7/2000 | Shimizu et al. |
| 6,102,538 | A | 8/2000 | Ochi et al. |
| 6,103,775 | A | 8/2000 | Bambara et al. |
| 6,108,513 | A | 8/2000 | Landa et al. |
| 6,109,746 | A | 8/2000 | Jeanmaire et al. |
| 6,132,541 | A | 10/2000 | Heaton |
| 6,143,807 | A | 11/2000 | Lin et al. |
| 6,166,105 | A | 12/2000 | Santilli et al. |
| 6,195,112 | B1 | 2/2001 | Fassler et al. |
| 6,196,674 | B1 | 3/2001 | Takemoto |
| 6,213,580 | B1 | 4/2001 | Segerstrom et al. |
| 6,214,894 | B1 | 4/2001 | Bambara et al. |
| 6,221,928 | B1 | 4/2001 | Kozma et al. |
| 6,234,625 | B1 | 5/2001 | Wen |
| 6,242,503 | B1 | 6/2001 | Kozma et al. |
| 6,257,716 | B1 | 7/2001 | Yanagawa et al. |
| 6,261,688 | B1 | 7/2001 | Kaplan et al. |
| 6,262,137 | B1 | 7/2001 | Kozma et al. |
| 6,262,207 | B1 | 7/2001 | Rao et al. |
| 6,303,215 | B1 | 10/2001 | Sonobe et al. |
| 6,316,512 | B1 | 11/2001 | Bambara et al. |
| 6,332,943 | B1 | 12/2001 | Herrmann et al. |
| 6,354,700 | B1 | 3/2002 | Roth |
| 6,357,869 | B1 | 3/2002 | Rasmussen et al. |
| 6,357,870 | B1 | 3/2002 | Beach et al. |
| 6,358,660 | B1 | 3/2002 | Agler et al. |
| 6,363,234 | B2 | 3/2002 | Landa et al. |
| 6,364,451 | B1 | 4/2002 | Silverbrook |
| 6,377,772 | B1 | 4/2002 | Chowdry et al. |
| 6,383,278 | B1 | 5/2002 | Hirasa et al. |
| 6,386,697 | B1 | 5/2002 | Yamamoto et al. |
| 6,390,617 | B1 | 5/2002 | Iwao |
| 6,396,528 | B1 | 5/2002 | Yanagawa |
| 6,397,034 | B1 | 5/2002 | Tarnawskyj et al. |
| 6,400,913 | B1 | 6/2002 | De Jong et al. |
| 6,402,317 | B2 | 6/2002 | Yanagawa et al. |
| 6,409,331 | B1 | 6/2002 | Gelbart |
| 6,432,501 | B1 | 8/2002 | Yang et al. |
| 6,438,352 | B1 | 8/2002 | Landa et al. |
| 6,454,378 | B1 | 9/2002 | Silverbrook et al. |
| 6,471,803 | B1 | 10/2002 | Pelland et al. |
| 6,530,321 | B2 | 3/2003 | Andrew et al. |
| 6,530,657 | B2 | 3/2003 | Polierer |
| 6,531,520 | B1 | 3/2003 | Bambara et al. |
| 6,551,394 | B2 | 4/2003 | Hirasa et al. |
| 6,551,716 | B1 | 4/2003 | Landa et al. |
| 6,554,189 | B1 | 4/2003 | Good et al. |
| 6,559,969 | B1 | 5/2003 | Lapstun |
| 6,575,547 | B2 | 6/2003 | Sakuma |
| 6,586,100 | B1 | 7/2003 | Pickering et al. |
| 6,590,012 | B2 | 7/2003 | Miyabayashi |
| 6,608,979 | B1 | 8/2003 | Landa et al. |
| 6,623,817 | B1 | 9/2003 | Yang et al. |
| 6,630,047 | B2 | 10/2003 | Jing et al. |
| 6,639,527 | B2 | 10/2003 | Johnson |
| 6,648,468 | B2 | 11/2003 | Shinkoda et al. |
| 6,678,068 | B1 | 1/2004 | Richter et al. |
| 6,682,189 | B2 | 1/2004 | May et al. |
| 6,685,769 | B1 | 2/2004 | Karl et al. |
| 6,704,535 | B2 | 3/2004 | Kobayashi et al. |
| 6,709,096 | B1 | 3/2004 | Beach et al. |
| 6,716,562 | B2 | 4/2004 | Uehara et al. |
| 6,719,423 | B2 | 4/2004 | Chowdry et al. |
| 6,720,367 | B2 | 4/2004 | Taniguchi et al. |
| 6,755,519 | B2 | 6/2004 | Gelbart et al. |
| 6,761,446 | B2 | 7/2004 | Chowdry et al. |

(56) References Cited

U.S. PATENT DOCUMENTS 6,770,331 B1 8/2004 Mielke et al.
6,789,887 B2 9/2004 Yang et al.
6,811,840 B1 11/2004 Cross
6,827,018 B1 12/2004 Hartmann et al.
6,881,458 B2 4/2005 Ludwig et al.
6,898,403 B2 5/2005 Baker et al.
6,912,952 B1 7/2005 Landa et al.
6,916,862 B2 7/2005 Ota et al.
6,917,437 B1 7/2005 Myers et al.
6,966,712 B2 11/2005 Trelewicz et al.
6,970,674 B2 11/2005 Sato et al.
6,974,022 B2 12/2005 Saeki
6,982,799 B2 1/2006 Lapstun
6,983,692 B2 1/2006 Beauchamp et al.
7,025,453 B2 4/2006 Ylitalo et al.
7,057,760 B2 6/2006 Lapstun et al.
7,084,202 B2 8/2006 Pickering et al.
7,128,412 B2 10/2006 King et al.
7,129,858 B2 10/2006 Ferran et al.
7,134,953 B2 11/2006 Reinke
7,160,377 B2 1/2007 Zoch et al.
7,204,584 B2 4/2007 Lean et al.
7,213,900 B2 5/2007 Ebihara
7,224,478 B1 5/2007 Lapstun et al.
7,265,819 B2 9/2007 Raney
7,271,213 B2 9/2007 Hoshida et al.
7,296,882 B2 11/2007 Buehler et al.
7,300,133 B1 11/2007 Folkins et al.
7,300,147 B2 11/2007 Johnson
7,304,753 B1 12/2007 Richter et al.
7,322,689 B2 1/2008 Kohne et al.
7,334,520 B2 2/2008 Geissler et al.
7,348,368 B2 3/2008 Kakiuchi et al.
7,360,887 B2 4/2008 Konno
7,362,464 B2 4/2008 Kitazawa
7,459,491 B2 12/2008 Tyvoll et al.
7,527,359 B2 5/2009 Stevenson et al.
7,575,314 B2 8/2009 Desie et al.
7,612,125 B2 11/2009 Muller et al.
7,655,707 B2 2/2010 Ma
7,655,708 B2 2/2010 House et al.
7,699,922 B2 4/2010 Breton et al.
7,708,371 B2 5/2010 Yamanobe
7,709,074 B2 5/2010 Uchida et al.
7,712,890 B2 5/2010 Yahiro
7,732,543 B2 6/2010 Loch et al.
7,732,583 B2 6/2010 Annoura et al.
7,808,670 B2 10/2010 Lapstun et al.
7,810,922 B2 10/2010 Gervasi et al.
7,845,788 B2 12/2010 Oku
7,867,327 B2 1/2011 Sano et al.
7,876,345 B2 1/2011 Houjou
7,910,183 B2 3/2011 Wu
7,919,544 B2 4/2011 Matsuyama et al.
7,942,516 B2 5/2011 Ohara et al.
7,977,408 B2 7/2011 Matsuyama et al.
7,985,784 B2 7/2011 Kanaya et al.
8,002,400 B2 8/2011 Kibayashi et al.
8,012,538 B2 9/2011 Yokouchi
8,025,389 B2 9/2011 Yamanobe et al.
8,038,284 B2 10/2011 Hori et al.
8,041,275 B2 10/2011 Soria et al.
8,042,906 B2 10/2011 Chiwata et al.
8,059,309 B2 11/2011 Lapstun et al.
8,095,054 B2 1/2012 Nakamura
8,109,595 B2 2/2012 Tanaka et al.
8,122,846 B2 2/2012 Stiblert et al.
8,147,055 B2 4/2012 Cellura et al.
8,162,428 B2 4/2012 Eun et al.
8,177,351 B2 5/2012 Taniuchi et al.
8,186,820 B2 5/2012 Chiwata
8,192,904 B2 6/2012 Nagai et al.
8,215,762 B2 7/2012 Ageishi
8,242,201 B2 8/2012 Goto et al.
8,256,857 B2 9/2012 Folkins et al.
8,263,683 B2 9/2012 Gibson et al.
8,264,135 B2 9/2012 Ozolins et al.
8,295,733 B2 10/2012 Imoto
8,303,072 B2 11/2012 Shibata et al.
8,304,043 B2 11/2012 Nagashima et al.
8,353,589 B2 1/2013 Ikeda et al.
8,434,847 B2 5/2013 Dejong et al.
8,460,450 B2 6/2013 Taverizatshy et al.
8,469,476 B2 6/2013 Mandel et al.
8,474,963 B2 7/2013 Hasegawa et al.
8,536,268 B2 9/2013 Karjala et al.
8,546,466 B2 10/2013 Yamashita et al.
8,556,400 B2 10/2013 Yatake et al.
8,693,032 B2 4/2014 Goddard et al.
8,711,304 B2 4/2014 Mathew et al.
8,714,731 B2 5/2014 Leung et al.
8,746,873 B2 6/2014 Tsukamoto et al.
8,779,027 B2 7/2014 Idemura et al.
8,802,221 B2 8/2014 Noguchi et al.
8,867,097 B2 10/2014 Mizuno
8,885,218 B2 11/2014 Hirose
8,891,128 B2 11/2014 Yamazaki
8,894,198 B2 11/2014 Hook et al.
8,919,946 B2 12/2014 Suzuki et al.
9,004,629 B2 4/2015 De Jong et al.
9,186,884 B2 11/2015 Landa et al.
9,227,429 B1 * 1/2016 LeStrange ..... B41J 11/007
9,229,664 B2 1/2016 Landa et al.
9,264,559 B2 2/2016 Motoyanagi et al.
9,284,469 B2 3/2016 Song et al.
9,290,016 B2 3/2016 Landa et al.
9,327,496 B2 5/2016 Landa et al.
9,353,273 B2 5/2016 Landa et al.
9,381,736 B2 7/2016 Landa et al.
9,446,586 B2 9/2016 Matos et al.
9,498,946 B2 11/2016 Landa et al.
9,505,208 B2 11/2016 Shmaiser et al.
9,517,618 B2 12/2016 Landa et al.
9,566,780 B2 2/2017 Landa et al.
9,568,862 B2 2/2017 Shmaiser et al.
9,643,400 B2 5/2017 Landa et al.
9,643,403 B2 5/2017 Landa et al.
9,776,391 B2 10/2017 Landa et al.
9,782,993 B2 10/2017 Landa et al.
9,849,667 B2 12/2017 Landa et al.
9,884,479 B2 2/2018 Landa et al.
9,902,147 B2 2/2018 Shmaiser et al.
9,914,316 B2 3/2018 Landa et al.
10,065,411 B2 9/2018 Landa et al.
10,175,613 B2 1/2019 Watanabe
10,179,447 B2 1/2019 Shmaiser et al.
10,190,012 B2 1/2019 Landa et al.
10,195,843 B2 2/2019 Landa et al.
10,201,968 B2 2/2019 Landa et al.
10,226,920 B2 3/2019 Shmaiser et al.
10,266,711 B2 4/2019 Landa et al.
10,300,690 B2 5/2019 Landa et al.
10,357,963 B2 7/2019 Landa et al.
10,357,985 B2 7/2019 Landa et al.
10,427,399 B2 10/2019 Shmaiser et al.
10,434,761 B2 10/2019 Landa et al.
10,477,188 B2 11/2019 Stiglic et al.
10,518,526 B2 12/2019 Landa et al.
10,569,532 B2 2/2020 Shmaiser et al.
10,569,533 B2 2/2020 Landa et al.
10,569,534 B2 2/2020 Shmaiser et al.
10,576,734 B2 3/2020 Landa et al.
10,596,804 B2 3/2020 Landa et al.
10,632,740 B2 4/2020 Landa et al.
10,642,198 B2 5/2020 Landa et al.
10,703,094 B2 7/2020 Shmaiser et al.
2001/0022607 A1 9/2001 Takahashi et al.
2002/0041317 A1 4/2002 Kashiwazaki et al.
2002/0064404 A1 5/2002 Iwai
2002/0102374 A1 8/2002 Gervasi et al.
2002/0121220 A1 9/2002 Lin
2002/0150408 A1 10/2002 Mosher et al.
2002/0164494 A1 11/2002 Grant et al.
2002/0197481 A1 12/2002 Jing et al.

(56) References Cited

U.S. PATENT DOCUMENTS

2003/0004025 A1 1/2003 Okuno et al.
2003/0018119 A1 1/2003 Frenkel et al.
2003/0030686 A1 2/2003 Abe et al.
2003/0032700 A1 2/2003 Morrison et al.
2003/0043258 A1 3/2003 Kerr et al.
2003/0054139 A1 3/2003 Ylitalo et al.
2003/0055129 A1 3/2003 Alford
2003/0063179 A1 4/2003 Adachi
2003/0064317 A1 4/2003 Bailey et al.
2003/0081964 A1 5/2003 Shimura et al.
2003/0118381 A1 6/2003 Law et al.
2003/0129435 A1 7/2003 Blankenship et al.
2003/0186147 A1 10/2003 Pickering et al.
2003/0214568 A1 11/2003 Nishikawa et al.
2003/0234849 A1 12/2003 Pan et al.
2004/0003863 A1 1/2004 Eckhardt
2004/0020382 A1 2/2004 McLean et al.
2004/0047666 A1 3/2004 Imaizumi et al.
2004/0087707 A1 5/2004 Zoch et al.
2004/0123761 A1 7/2004 Szumla et al.
2004/0125188 A1 7/2004 Szumla et al.
2004/0173111 A1 9/2004 Okuda
2004/0200369 A1 10/2004 Brady
2004/0228642 A1 11/2004 Iida et al.
2004/0246324 A1 12/2004 Nakashima
2004/0246326 A1 12/2004 Dwyer et al.
2004/0252175 A1 12/2004 Bejat et al.
2005/0031807 A1 2/2005 Quintens et al.
2005/0082146 A1 4/2005 Axmann
2005/0110855 A1 5/2005 Taniuchi et al.
2005/0111861 A1 5/2005 Calamita et al.
2005/0134874 A1 6/2005 Overall et al.
2005/0150408 A1 7/2005 Hesterman
2005/0185009 A1 8/2005 Claramunt et al.
2005/0195235 A1 9/2005 Kitao
2005/0235870 A1 10/2005 Ishihara
2005/0266332 A1 12/2005 Pavlisko et al.
2005/0272334 A1 12/2005 Wang et al.
2006/0004123 A1 1/2006 Wu et al.
2006/0135709 A1 6/2006 Hasegawa et al.
2006/0164488 A1 7/2006 Taniuchi et al.
2006/0164489 A1 7/2006 Vega et al.
2006/0192827 A1 8/2006 Takada et al.
2006/0233578 A1 10/2006 Maki et al.
2006/0286462 A1 12/2006 Jackson et al.
2007/0014595 A1 1/2007 Kawagoe
2007/0025768 A1 2/2007 Komatsu et al.
2007/0029171 A1 2/2007 Nemedi
2007/0045939 A1 3/2007 Toya et al.
2007/0054981 A1 3/2007 Yanagi et al.
2007/0064077 A1 3/2007 Konno
2007/0077520 A1 4/2007 Maemoto
2007/0120927 A1 5/2007 Snyder et al.
2007/0123642 A1 5/2007 Banning et al.
2007/0134030 A1 6/2007 Lior et al.
2007/0144368 A1 6/2007 Barazani et al.
2007/0146462 A1 6/2007 Taniuchi et al.
2007/0147894 A1 6/2007 Yokota
2007/0166071 A1 7/2007 Shima
2007/0176995 A1 8/2007 Kadomatsu et al.
2007/0189819 A1 8/2007 Uehara et al.
2007/0199457 A1 8/2007 Cyman et al.
2007/0229639 A1 10/2007 Yahiro
2007/0253726 A1 11/2007 Kagawa
2007/0257955 A1 11/2007 Tanaka et al.
2007/0285486 A1 12/2007 Harris et al.
2008/0006176 A1 1/2008 Houjou
2008/0030536 A1 2/2008 Furukawa et al.
2008/0032072 A1 2/2008 Taniuchi et al.
2008/0044587 A1 2/2008 Maeno et al.
2008/0055356 A1 3/2008 Yamanobe
2008/0055381 A1 3/2008 Doi et al.
2008/0074462 A1 3/2008 Hirakawa
2008/0112912 A1 5/2008 Springob et al.
2008/0138546 A1 6/2008 Soria et al.
2008/0166495 A1 7/2008 Maeno et al.
2008/0167185 A1 7/2008 Hirota
2008/0175612 A1 7/2008 Oikawa et al.
2008/0196612 A1 8/2008 Rancourt et al.
2008/0196621 A1 8/2008 Ikuno et al.
2008/0213548 A1 9/2008 Koganehira et al.
2008/0236480 A1 10/2008 Furukawa et al.
2008/0253812 A1 10/2008 Pearce et al.
2009/0022504 A1 1/2009 Kuwabara et al.
2009/0041515 A1 2/2009 Kim
2009/0041932 A1 2/2009 Ishizuka et al.
2009/0064884 A1 3/2009 Hook et al.
2009/0074492 A1 3/2009 Ito
2009/0082503 A1 3/2009 Yanagi et al.
2009/0087565 A1 4/2009 Houjou
2009/0098385 A1 4/2009 Kaemper et al.
2009/0116885 A1 5/2009 Ando
2009/0148200 A1 6/2009 Hara et al.
2009/0165937 A1 7/2009 Inoue et al.
2009/0190951 A1 7/2009 Torimaru et al.
2009/0202275 A1 8/2009 Nishida et al.
2009/0211490 A1 8/2009 Ikuno et al.
2009/0220873 A1 9/2009 Enomoto et al.
2009/0237479 A1 9/2009 Yamashita et al.
2009/0256896 A1 10/2009 Scarlata
2009/0279170 A1 11/2009 Miyazaki et al.
2009/0315926 A1 12/2009 Yamanobe
2009/0317555 A1 12/2009 Hori
2009/0318591 A1 12/2009 Ageishi et al.
2010/0012023 A1 1/2010 Lefevre et al.
2010/0053292 A1 3/2010 Thayer et al.
2010/0053293 A1 3/2010 Thayer et al.
2010/0066796 A1 3/2010 Yanagi et al.
2010/0075843 A1 3/2010 Ikuno et al.
2010/0086692 A1 4/2010 Ohta
2010/0091064 A1 4/2010 Araki et al.
2010/0225695 A1 9/2010 Fujikura
2010/0231623 A1 9/2010 Hirato
2010/0239789 A1 9/2010 Umeda
2010/0245511 A1 9/2010 Ageishi
2010/0282100 A1 11/2010 Okuda et al.
2010/0285221 A1 11/2010 Oki et al.
2010/0303504 A1 12/2010 Funamoto et al.
2010/0310281 A1 12/2010 Miura et al.
2011/0044724 A1 2/2011 Funamoto et al.
2011/0058001 A1 3/2011 Gila et al.
2011/0058859 A1 3/2011 Nakamatsu et al.
2011/0085828 A1 4/2011 Kosako et al.
2011/0128300 A1 6/2011 Gay et al.
2011/0141188 A1 6/2011 Morita
2011/0149002 A1 6/2011 Kessler
2011/0150509 A1 6/2011 Komiya
2011/0150541 A1 6/2011 Michibata
2011/0169889 A1 7/2011 Kojima et al.
2011/0195260 A1 8/2011 Lee et al.
2011/0199414 A1 8/2011 Lang
2011/0234683 A1 9/2011 Komatsu
2011/0234689 A1 9/2011 Saito
2011/0249090 A1 10/2011 Moore et al.
2011/0269885 A1 11/2011 Imai
2011/0279554 A1 11/2011 Dannhauser et al.
2011/0304674 A1 12/2011 Sambhy et al.
2012/0013693 A1 1/2012 Tasaka et al.
2012/0013694 A1 1/2012 Kanke
2012/0013928 A1 1/2012 Yoshida et al.
2012/0026224 A1 2/2012 Anthony et al.
2012/0039647 A1 2/2012 Brewington et al.
2012/0094091 A1 4/2012 Van Mil et al.
2012/0098882 A1 4/2012 Onishi et al.
2012/0105561 A1 5/2012 Taniuchi et al.
2012/0105562 A1 5/2012 Sekiguchi et al.
2012/0113180 A1 5/2012 Tanaka et al.
2012/0113203 A1 5/2012 Kushida et al.
2012/0127250 A1 5/2012 Kanasugi et al.
2012/0127251 A1 5/2012 Tsuji et al.
2012/0140009 A1 6/2012 Kanasugi et al.
2012/0154497 A1 6/2012 Nakao et al.
2012/0156375 A1 6/2012 Brust et al.
2012/0156624 A1 6/2012 Rondon et al.

(56) References Cited

U.S. PATENT DOCUMENTS

| | | | |
|---|---|---|---|
| 2012/0162302 | A1 | 6/2012 | Oguchi et al. |
| 2012/0163846 | A1 | 6/2012 | Andoh et al. |
| 2012/0194830 | A1 | 8/2012 | Gaertner et al. |
| 2012/0237260 | A1 | 9/2012 | Sengoku et al. |
| 2012/0287260 | A1 | 11/2012 | Lu et al. |
| 2012/0301186 | A1 | 11/2012 | Yang et al. |
| 2012/0314077 | A1 | 12/2012 | Clavenna, II et al. |
| 2013/0017006 | A1 | 1/2013 | Suda |
| 2013/0044188 | A1 | 2/2013 | Nakamura et al. |
| 2013/0057603 | A1 | 3/2013 | Gordon |
| 2013/0088543 | A1 | 4/2013 | Tsuji et al. |
| 2013/0120513 | A1 | 5/2013 | Thayer et al. |
| 2013/0201237 | A1 | 8/2013 | Thomson et al. |
| 2013/0234080 | A1 | 9/2013 | Torikoshi et al. |
| 2013/0242016 | A1 | 9/2013 | Edwards et al. |
| 2013/0338273 | A1 | 12/2013 | Shimanaka et al. |
| 2014/0001013 | A1 | 1/2014 | Takifuji et al. |
| 2014/0011125 | A1 | 1/2014 | Inoue et al. |
| 2014/0043398 | A1 | 2/2014 | Butler et al. |
| 2014/0104360 | A1 | 4/2014 | Häcker et al. |
| 2014/0168330 | A1 | 6/2014 | Liu et al. |
| 2014/0175707 | A1 | 6/2014 | Wolk et al. |
| 2014/0232782 | A1 | 8/2014 | Mukai et al. |
| 2014/0267777 | A1 | 9/2014 | Le Clerc et al. |
| 2014/0339056 | A1 | 11/2014 | Iwakoshi et al. |
| 2015/0024648 | A1 | 1/2015 | Landa et al. |
| 2015/0025179 | A1 | 1/2015 | Landa et al. |
| 2015/0072090 | A1 | 3/2015 | Landa et al. |
| 2015/0085036 | A1 | 3/2015 | Liu et al. |
| 2015/0085037 | A1 | 3/2015 | Liu et al. |
| 2015/0116408 | A1 | 4/2015 | Armbruster et al. |
| 2015/0118503 | A1 | 4/2015 | Landa et al. |
| 2015/0195509 | A1 | 7/2015 | Phipps |
| 2015/0210065 | A1 | 7/2015 | Kelly et al. |
| 2015/0304531 | A1 | 10/2015 | Rodriguez Garcia et al. |
| 2015/0336378 | A1 | 11/2015 | Guttmann et al. |
| 2015/0361288 | A1 | 12/2015 | Song et al. |
| 2016/0031246 | A1 | 2/2016 | Sreekumar et al. |
| 2016/0222232 | A1 | 8/2016 | Landa et al. |
| 2016/0286462 | A1 | 9/2016 | Gohite et al. |
| 2016/0375680 | A1 | 12/2016 | Nishitani et al. |
| 2017/0028688 | A1 | 2/2017 | Dannhauser et al. |
| 2017/0104887 | A1 | 4/2017 | Nomura |
| 2018/0259888 | A1 | 9/2018 | Mitsui et al. |
| 2019/0016114 | A1 | 1/2019 | Sugiyama et al. |
| 2019/0023919 | A1 | 1/2019 | Landa et al. |
| 2019/0152218 | A1 | 5/2019 | Stein et al. |
| 2019/0218411 | A1 | 7/2019 | Landa et al. |
| 2019/0256724 | A1 | 8/2019 | Landa et al. |
| 2019/0358982 | A1 | 11/2019 | Landa et al. |
| 2019/0366705 | A1 | 12/2019 | Landa et al. |
| 2019/0389230 | A1 | 12/2019 | Landa et al. |
| 2020/0062002 | A1 | 2/2020 | Landa et al. |
| 2020/0156366 | A1 | 5/2020 | Shmaiser et al. |
| 2020/0171813 | A1 | 6/2020 | Chechik et al. |
| 2020/0189264 | A1 | 6/2020 | Landa et al. |
| 2020/0198322 | A1 | 6/2020 | Landa et al. |

FOREIGN PATENT DOCUMENTS

| | | | |
|---|---|---|---|
| CN | 1212229 | A | 3/1999 |
| CN | 1324901 | A | 12/2001 |
| CN | 1445622 | A | 10/2003 |
| CN | 1493514 | A | 5/2004 |
| CN | 1535235 | A | 10/2004 |
| CN | 1720187 | A | 1/2006 |
| CN | 1261831 | C | 6/2006 |
| CN | 1809460 | A | 7/2006 |
| CN | 1289368 | C | 12/2006 |
| CN | 101073937 | A | 11/2007 |
| CN | 101177057 | A | 5/2008 |
| CN | 101249768 | A | 8/2008 |
| CN | 101344746 | A | 1/2009 |
| CN | 101359210 | A | 2/2009 |
| CN | 101508200 | A | 8/2009 |
| CN | 101524916 | A | 9/2009 |
| CN | 101544100 | A | 9/2009 |
| CN | 101544101 | A | 9/2009 |
| CN | 101607468 | A | 12/2009 |
| CN | 201410787 | Y | 2/2010 |
| CN | 101835611 | A | 9/2010 |
| CN | 101835612 | A | 9/2010 |
| CN | 101873982 | A | 10/2010 |
| CN | 102248776 | A | 11/2011 |
| CN | 102555450 | A | 7/2012 |
| CN | 102648095 | A | 8/2012 |
| CN | 102925002 | A | 2/2013 |
| CN | 103045008 | A | 4/2013 |
| CN | 103309213 | A | 9/2013 |
| CN | 103991293 | A | 8/2014 |
| CN | 104220934 | A | 12/2014 |
| CN | 104271356 | A | 1/2015 |
| CN | 104284850 | A | 1/2015 |
| CN | 104618642 | A | 5/2015 |
| CN | 105058999 | A | 11/2015 |
| DE | 102010060999 | A1 | 6/2012 |
| EP | 0457551 | A2 | 11/1991 |
| EP | 0499857 | A1 | 8/1992 |
| EP | 0606490 | A1 | 7/1994 |
| EP | 0609076 | A2 | 8/1994 |
| EP | 0613791 | A2 | 9/1994 |
| EP | 0530627 | B1 | 3/1997 |
| EP | 0784244 | A2 | 7/1997 |
| EP | 0835762 | A1 | 4/1998 |
| EP | 0843236 | A2 | 5/1998 |
| EP | 0854398 | A2 | 7/1998 |
| EP | 1013466 | A2 | 6/2000 |
| EP | 1146090 | A2 | 10/2001 |
| EP | 1158029 | A1 | 11/2001 |
| EP | 0825029 | B1 | 5/2002 |
| EP | 1247821 | A2 | 10/2002 |
| EP | 0867483 | B1 | 6/2003 |
| EP | 1454968 | A1 | 9/2004 |
| EP | 1503326 | A1 | 2/2005 |
| EP | 1777243 | A1 | 4/2007 |
| EP | 2028238 | A1 | 2/2009 |
| EP | 2042317 | A1 | 4/2009 |
| EP | 2065194 | A2 | 6/2009 |
| EP | 2228210 | A1 | 9/2010 |
| EP | 2270070 | A1 | 1/2011 |
| EP | 2042318 | B1 | 2/2011 |
| EP | 2042325 | B1 | 2/2012 |
| EP | 2634010 | A1 | 9/2013 |
| EP | 2683556 | A1 | 1/2014 |
| EP | 2075635 | B1 | 10/2014 |
| EP | 2823363 | B1 | 10/2018 |
| GB | 748821 | A | 5/1956 |
| GB | 1496016 | A | 12/1977 |
| GB | 1520932 | A | 8/1978 |
| GB | 1522175 | A | 8/1978 |
| GB | 2321430 | A | 7/1998 |
| JP | S5578904 | A | 6/1980 |
| JP | S57121446 | U | 7/1982 |
| JP | S6076343 | A | 4/1985 |
| JP | S60199692 | A | 10/1985 |
| JP | S6223783 | A | 1/1987 |
| JP | H03248170 | A | 11/1991 |
| JP | H05147208 | A | 6/1993 |
| JP | H05192871 | A | 8/1993 |
| JP | H05297737 | A | 11/1993 |
| JP | H06954 | A | 1/1994 |
| JP | H06100807 | A | 4/1994 |
| JP | H06171076 | A | 6/1994 |
| JP | H06345284 | A | 12/1994 |
| JP | H07112841 | A | 5/1995 |
| JP | H07186453 | A | 7/1995 |
| JP | H07238243 | A | 9/1995 |
| JP | H0862999 | A | 3/1996 |
| JP | H08112970 | A | 5/1996 |
| JP | 2529651 | B2 | 8/1996 |
| JP | H09123432 | A | 5/1997 |
| JP | H09157559 | A | 6/1997 |
| JP | H09281851 | A | 10/1997 |
| JP | H09314867 | A | 12/1997 |

(56) References Cited

FOREIGN PATENT DOCUMENTS

| | | | |
|---|---|---|---|
| JP | H1142811 | A | 2/1999 |
| JP | H11503244 | A | 3/1999 |
| JP | H11106081 | A | 4/1999 |
| JP | H11245383 | A | 9/1999 |
| JP | 2000108320 | A | 4/2000 |
| JP | 2000108334 | A | 4/2000 |
| JP | 2000141710 | A | 5/2000 |
| JP | 2000168062 | A | 6/2000 |
| JP | 2000169772 | A | 6/2000 |
| JP | 2000206801 | A | 7/2000 |
| JP | 2001088430 | A | 4/2001 |
| JP | 2001098201 | A | 4/2001 |
| JP | 2001139865 | A | 5/2001 |
| JP | 3177985 | B2 | 6/2001 |
| JP | 2001164165 | A | 6/2001 |
| JP | 2001199150 | A | 7/2001 |
| JP | 2001206522 | A | 7/2001 |
| JP | 2002020666 | A | 1/2002 |
| JP | 2002504446 | A | 2/2002 |
| JP | 2002069346 | A | 3/2002 |
| JP | 2002103598 | A | 4/2002 |
| JP | 2002169383 | A | 6/2002 |
| JP | 2002229276 | A | 8/2002 |
| JP | 2002234243 | A | 8/2002 |
| JP | 2002278365 | A | 9/2002 |
| JP | 2002304066 | A | 10/2002 |
| JP | 2002326733 | A | 11/2002 |
| JP | 2002371208 | A | 12/2002 |
| JP | 2003057967 | A | 2/2003 |
| JP | 2003114558 | A | 4/2003 |
| JP | 2003145914 | A | 5/2003 |
| JP | 2003183557 | A | 7/2003 |
| JP | 2003211770 | A | 7/2003 |
| JP | 2003219271 | A | 7/2003 |
| JP | 2003246135 | A | 9/2003 |
| JP | 2003246484 | A | 9/2003 |
| JP | 2003292855 | A | 10/2003 |
| JP | 2003313466 | A | 11/2003 |
| JP | 2004009632 | A | 1/2004 |
| JP | 2004019022 | A | 1/2004 |
| JP | 2004025708 | A | 1/2004 |
| JP | 2004034441 | A | 2/2004 |
| JP | 2004077669 | A | 3/2004 |
| JP | 2004114377 | A | 4/2004 |
| JP | 2004114675 | A | 4/2004 |
| JP | 2004148687 | A | 5/2004 |
| JP | 2004231711 | A | 8/2004 |
| JP | 2004524190 | A | 8/2004 |
| JP | 2004261975 | A | 9/2004 |
| JP | 2004325782 | A | 11/2004 |
| JP | 2005014255 | A | 1/2005 |
| JP | 2005014256 | A | 1/2005 |
| JP | 2005114769 | A | 4/2005 |
| JP | 2005215247 | A | 8/2005 |
| JP | 2005307184 | A | 11/2005 |
| JP | 2005319593 | A | 11/2005 |
| JP | 2006001688 | A | 1/2006 |
| JP | 2006023403 | A | 1/2006 |
| JP | 2006095870 | A | 4/2006 |
| JP | 2006102975 | A | 4/2006 |
| JP | 2006137127 | A | 6/2006 |
| JP | 2006143778 | A | 6/2006 |
| JP | 2006152133 | A | 6/2006 |
| JP | 2006224583 | A | 8/2006 |
| JP | 2006231666 | A | 9/2006 |
| JP | 2006234212 | A | 9/2006 |
| JP | 2006243212 | A | 9/2006 |
| JP | 2006263984 | A | 10/2006 |
| JP | 2006347081 | A | 12/2006 |
| JP | 2006347085 | A | 12/2006 |
| JP | 2007025246 | A | 2/2007 |
| JP | 2007041530 | A | 2/2007 |
| JP | 2007069584 | A | 3/2007 |
| JP | 2007083445 | A | 4/2007 |
| JP | 2007190745 | A | 8/2007 |
| JP | 2007216673 | A | 8/2007 |
| JP | 2007253347 | A | 10/2007 |
| JP | 2007334125 | A | 12/2007 |
| JP | 2008006816 | A | 1/2008 |
| JP | 2008018716 | A | 1/2008 |
| JP | 2008019286 | A | 1/2008 |
| JP | 2008036968 | A | 2/2008 |
| JP | 2008137239 | A | 6/2008 |
| JP | 2008139877 | A | 6/2008 |
| JP | 2008142962 | A | 6/2008 |
| JP | 2008183744 | A | 8/2008 |
| JP | 2008194997 | A | 8/2008 |
| JP | 2008532794 | A | 8/2008 |
| JP | 2008201564 | A | 9/2008 |
| JP | 2008238674 | A | 10/2008 |
| JP | 2008246787 | A | 10/2008 |
| JP | 2008246990 | A | 10/2008 |
| JP | 2008254203 | A | 10/2008 |
| JP | 2008255135 | A | 10/2008 |
| JP | 2009040892 | A | 2/2009 |
| JP | 2009045794 | A | 3/2009 |
| JP | 2009045851 | A | 3/2009 |
| JP | 2009045885 | A | 3/2009 |
| JP | 2009083314 | A | 4/2009 |
| JP | 2009083317 | A | 4/2009 |
| JP | 2009083325 | A | 4/2009 |
| JP | 2009096175 | A | 5/2009 |
| JP | 2009148908 | A | 7/2009 |
| JP | 2009154330 | A | 7/2009 |
| JP | 2009190375 | A | 8/2009 |
| JP | 2009202355 | A | 9/2009 |
| JP | 2009214318 | A | 9/2009 |
| JP | 2009214439 | A | 9/2009 |
| JP | 2009226852 | A | 10/2009 |
| JP | 2009226886 | A | 10/2009 |
| JP | 2009233977 | A | 10/2009 |
| JP | 2009234219 | A | 10/2009 |
| JP | 2010005815 | A | 1/2010 |
| JP | 2010054855 | A | 3/2010 |
| JP | 2010510357 | A | 4/2010 |
| JP | 2010105365 | A | 5/2010 |
| JP | 2010173201 | A | 8/2010 |
| JP | 2010184376 | A | 8/2010 |
| JP | 2010214885 | A | 9/2010 |
| JP | 2010228192 | A | 10/2010 |
| JP | 2010228392 | A | 10/2010 |
| JP | 2010234599 | A | 10/2010 |
| JP | 2010234681 | A | 10/2010 |
| JP | 2010241073 | A | 10/2010 |
| JP | 2010247381 | A | 11/2010 |
| JP | 2010247528 | A | 11/2010 |
| JP | 2010258193 | A | 11/2010 |
| JP | 2010260204 | A | 11/2010 |
| JP | 2010260287 | A | 11/2010 |
| JP | 2010260302 | A | 11/2010 |
| JP | 2010286570 | A | 12/2010 |
| JP | 2011002532 | A | 1/2011 |
| JP | 2011025431 | A | 2/2011 |
| JP | 2011037070 | A | 2/2011 |
| JP | 2011067956 | A | 4/2011 |
| JP | 2011126031 | A | 6/2011 |
| JP | 2011133884 | A | 7/2011 |
| JP | 2011144271 | A | 7/2011 |
| JP | 2011523601 | A | 8/2011 |
| JP | 2011173325 | A | 9/2011 |
| JP | 2011173326 | A | 9/2011 |
| JP | 2011186346 | A | 9/2011 |
| JP | 2011189627 | A | 9/2011 |
| JP | 2011201951 | A | 10/2011 |
| JP | 2011224032 | A | 11/2011 |
| JP | 2012042943 | A | 3/2012 |
| JP | 2012086499 | A | 5/2012 |
| JP | 2012111194 | A | 6/2012 |
| JP | 2012126123 | A | 7/2012 |
| JP | 2012139905 | A | 7/2012 |
| JP | 2012196787 | A | 10/2012 |
| JP | 2012201419 | A | 10/2012 |
| JP | 2013001081 | A | 1/2013 |
| JP | 2013060299 | A | 4/2013 |

(56) References Cited

FOREIGN PATENT DOCUMENTS

| | | | |
|---|---|---|---|
| JP | 2013103474 | A | 5/2013 |
| JP | 2013121671 | A | 6/2013 |
| JP | 2013129158 | A | 7/2013 |
| JP | 2014047005 | A | 3/2014 |
| JP | 2014094827 | A | 5/2014 |
| JP | 2016185688 | A | 10/2016 |
| JP | 2016539830 | A | 12/2016 |
| RU | 2180675 | C2 | 3/2002 |
| RU | 2282643 | C1 | 8/2006 |
| WO | WO-8600327 | A1 | 1/1986 |
| WO | WO-9307000 | A1 | 4/1993 |
| WO | WO-9604339 | A1 | 2/1996 |
| WO | WO-9631809 | A1 | 10/1996 |
| WO | WO-9707991 | A1 | 3/1997 |
| WO | WO-9736210 | A1 | 10/1997 |
| WO | WO-9821251 | A1 | 5/1998 |
| WO | WO-9855901 | A1 | 12/1998 |
| WO | WO-9912633 | A1 | 3/1999 |
| WO | WO-9942509 | A1 | 8/1999 |
| WO | WO-9943502 | A2 | 9/1999 |
| WO | WO-0064685 | A1 | 11/2000 |
| WO | WO-0154902 | A1 | 8/2001 |
| WO | WO-0170512 | A1 | 9/2001 |
| WO | WO-02068191 | A1 | 9/2002 |
| WO | WO-02078868 | A2 | 10/2002 |
| WO | WO-02094912 | A1 | 11/2002 |
| WO | WO-2004113082 | A1 | 12/2004 |
| WO | WO-2004113450 | A1 | 12/2004 |
| WO | WO-2006051733 | A1 | 5/2006 |
| WO | WO-2006069205 | A1 | 6/2006 |
| WO | WO-2006073696 | A1 | 7/2006 |
| WO | WO-2006091957 | A2 | 8/2006 |
| WO | WO-2007009871 | A2 | 1/2007 |
| WO | WO-2007145378 | A1 | 12/2007 |
| WO | WO-2008078841 | A1 | 7/2008 |
| WO | WO-2009025809 | A1 | 2/2009 |
| WO | WO-2009134273 | A1 | 11/2009 |
| WO | WO-2010042784 | A3 | 7/2010 |
| WO | WO-2010073916 | A1 | 7/2010 |
| WO | WO-2011142404 | A1 | 11/2011 |
| WO | WO-2012014825 | A1 | 2/2012 |
| WO | WO-2012148421 | A1 | 11/2012 |
| WO | WO-2013060377 | A1 | 5/2013 |
| WO | WO-2013087249 | A1 | 6/2013 |
| WO | WO-2013132339 | A1 | 9/2013 |
| WO | WO-2013132340 | A1 | 9/2013 |
| WO | WO-2013132343 | A1 | 9/2013 |
| WO | WO-2013132345 | A1 | 9/2013 |
| WO | WO-2013132356 | A1 | 9/2013 |
| WO | WO-2013132418 | A2 | 9/2013 |
| WO | WO-2013132419 | A1 | 9/2013 |
| WO | WO-2013132420 | A1 | 9/2013 |
| WO | WO-2013132424 | A1 | 9/2013 |
| WO | WO-2013132432 | A1 | 9/2013 |
| WO | WO-2013132438 | A2 | 9/2013 |
| WO | WO-2013132439 | A1 | 9/2013 |
| WO | WO-2013136220 | A1 | 9/2013 |
| WO | WO-2015036864 | A1 | 3/2015 |
| WO | WO-2015036906 | A1 | 3/2015 |
| WO | WO-2015036960 | A1 | 3/2015 |
| WO | WO-2016166690 | A1 | 10/2016 |
| WO | WO-2017208246 | A1 | 12/2017 |

OTHER PUBLICATIONS

BASF , "JONCRYL 537", Datasheet , Retrieved from the internet : Mar. 23, 2007 p. 1.

Clariant., "Ultrafine Pigment Dispersion for Design and Creative Materials: Hostafine Pigment Preparation" Jun. 19, 2008. Retrieved from the Internet: [URL: http://www.clariant.com/C125720D002B963C/4352D0BC052E90CEC1257479002707D9/$FILE/DP6208E_0608_FL_Hostafinefordesignandcreativematerials.pdf].

CN101073937A Machine Translation (by EPO and Google)—published Nov. 21, 2007; Werner Kaman Maschinen Gmbh & [DE].

CN101177057 Machine Translation (by EPO and Google)—published May 14, 2008—Hangzhou Yuanyang Industry Co.

CN101249768A Machine Translation (by EPO and Google)—published Aug. 27, 2008; Shantou Xinxie Special Paper T [CN].

CN101344746A Machine Translation (by EPO and Google)—published Jan. 14, 2009; Ricoh KK [JP].

CN101359210A Machine Translation (by EPO and Google)—published Feb. 4, 2009; Canon KK [JP].

CN101524916A Machine Translation (by EPO and Google)—published Sep. 9, 2009; Fuji Xerox Co Ltd.

CN101544100A Machine Translation (by EPO and Google)—published Sep. 30, 2009; Fuji Xerox Co Ltd.

CN101873982A Machine Translation (by EPO and Google)—published Oct. 27, 2010; Habasit AG, Delair et al.

CN102648095A Machine Translation (by EPO and Google)—published Aug. 22, 2012; Mars Inc.

CN102925002 Machine Translation (by EPO and Google)—published Feb. 13, 2013; Jiangnan University, Fu et al.

CN103045008A Machine Translation (by EPO and Google)—published Apr. 17, 2013; Fuji Xerox Co Ltd.

CN103991293A Machine Translation (by EPO and Google)—published Aug. 20, 2014; Miyakoshi Printing Machinery Co., Ltd, Junichi et al.

CN104618642 Machine Translation (by EPO and Google); published on May 13, 2015, Yulong Comp Comm Tech Shenzhen.

CN105058999A Machine Translation (by EPO and Google)—published Nov. 18, 2015; Zhuoli Imaging Technology Co Ltd.

CN1121033A Machine Translation (by EPO and Google)—published Apr. 24, 1996; Kuehnle Manfred R [US].

CN1212229A Machine Translation (by EPO and Google)—published Mar. 31, 1999; Honta Industry Corp [JP].

CN1493514A Machine Translation (by EPO and Google)—published May 5, 2004; GD SPA, Boderi et al.

CN1809460A Machine Translation (by EPO and Google)—published Jul. 26, 2006; Canon KK.

CN201410787Y Machine Translation (by EPO and Google)—published Feb. 24, 2010; Zhejiang Chanx Wood Co Ltd.

Co-pending U.S. Appl. No. 16/512,915, filed Jul. 16, 2019.

Co-pending U.S. Appl. No. 16/590,397, filed Oct. 2, 2019.

Co-pending U.S. Appl. No. 16/764,330, filed May 14, 2020.

Co-pending U.S. Appl. No. 16/765,878, filed May 21, 2020.

Co-pending U.S. Appl. No. 16/784,208, filed Feb. 6, 2020.

Co-pending U.S. Appl. No. 16/793,995, filed Feb. 18, 2020.

Co-pending U.S. Appl. No. 16/814,900, filed Mar. 11, 2020.

Co-pending U.S. Appl. No. 16/850,229, filed Apr. 16, 2020.

Co-pending U.S. Appl. No. 16/883,617, filed May 26, 2020.

DE102010060999 Machine Translation (by EPO and Google)—published Jun. 6, 2012; Wolf, Roland, Dr.-Ing.

Epomin Polyment, product information from Nippon Shokubai, dated Feb. 28, 2014.

Flexicon., "Bulk Handling Equipment and Systems: Carbon Black," 2018, 2 pages.

Handbook of Print Media, 2001, Springer Verlag, Berlin/Heidelberg/New York, pp. 127-136,748—With English Translation.

IP.com Search, 2018, 2 pages.

IP.com Search, 2019, 1 page.

JP2000108320 Machine Translation (by PlatPat English machine translation)—published Apr. 18, 2000 Brother Ind. Ltd.

JP2000108334A Machine Translation (by EPO and Google)—published Apr. 18, 2000; Brother Ind Ltd.

JP2000141710A Machine Translation (by EPO and Google)—published May 23, 2000; Brother Ind Ltd.

JP2000168062A Machine Translation (by EPO and Google)—published Jun. 20, 2000; Brother Ind Ltd.

JP2000169772 Machine Translation (by EPO and Google)—published Jun. 20, 2000; Tokyo Ink MFG Co Ltd.

JP2000206801 Machine Translation (by PlatPat English machine translation); published on Jul. 28, 2000, Canon KK, Kobayashi et al.

JP2001088430A Machine Translation (by EPO and Google)—published Apr. 3, 2001; Kimoto KK.

JP2001098201A Machine Translation (by EPO and Google)—published Apr. 10, 2001; Eastman Kodak Co.

(56) References Cited

OTHER PUBLICATIONS

JP2001139865A Machine Translation (by EPO and Google)—published May 22, 2001; Sharp KK.
JP2001164165A Machine Translation (by EPO and Google)—published Jun. 19, 2001; Dainippon Ink & Chemicals.
JP2001199150A Machine Translation (by EPO and Google)—published Jul. 24, 2001; Canon KK.
JP2001206522 Machine Translation (by EPO, PlatPat and Google)—published Jul. 31, 2001; Nitto Denko Corp, Kato et al.
JP2002069346A Machine Translation (by EPO and Google)—published Mar. 8, 2002; Dainippon Ink & Chemicals.
JP2002103598A Machine Translation (by EPO and Google)—published Apr. 9, 2002; Olympus Optical Co.
JP2002169383 Machine Translation (by EPO, PlatPat and Google)—published Jun. 14, 2002 Richo KK.
JP2002234243 Machine Translation (by EPO and Google)—published Aug. 20, 2002; Hitachi Koki Co Ltd.
JP2002278365 Machine Translation (by PlatPat English machine translation)—published Sep. 27, 2002 Katsuaki, Ricoh KK.
JP2002304066A Machine Translation (by EPO and Google)—published Oct. 18, 2002; PFU Ltd.
JP2002326733 Machine Translation (by EPO, PlatPat and Google)—published Nov. 12, 2002; Kyocera Mita Corp.
JP2002371208 Machine Translation (by EPO and Google)—published Dec. 26, 2002; Canon Inc.
JP2003114558 Machine Translation (by EPO, PlatPat and Google)—published Apr. 18, 2003 Mitsubishi Chem Corp, Yuka Denshi Co Ltd, et al.
JP2003145914A Machine Translation (by EPO and Google)—published May 21, 2003; Konishiroku Photo Ind.
JP2003211770 Machine Translation (by EPO and Google)—published Jul. 29, 2003 Hitachi Printing Solutions.
JP2003219271 Machine Translation (by EPO and Google); published on Jul. 31, 2003, Japan Broadcasting.
JP2003246135 Machine Translation (by PlatPat English machine translation)—published Sep. 2, 2003 Ricoh KK, Morohoshi et al.
JP2003246484 Machine Translation (English machine translation)—published Sep. 2, 2003 Kyocera Corp.
JP2003292855A Machine Translation (by EPO and Google)—published Oct. 15, 2003; Konishiroku Photo Ind.
JP2003313466A Machine Translation (by EPO and Google)—published Nov. 6, 2003; Ricoh KK.
JP2004009632A Machine Translation (by EPO and Google)—published Jan. 15, 2004; Konica Minolta Holdings Inc.
JP2004019022 Machine Translation (by EPO and Google)—published Jan. 22, 2004; Yamano et al.
JP2004025708A Machine Translation (by EPO and Google)—published Jan. 29, 2004; Konica Minolta Holdings Inc.
JP2004034441A Machine Translation (by EPO and Google)—published Feb. 5, 2004; Konica Minolta Holdings Inc.
JP2004077669 Machine Translation (by PlatPat English machine translation)—published Mar. 11, 2004 Fuji Xerox Co Ltd.
JP2004114377(A) Machine Translation (by EPO and Google)—published Apr. 15, 2004; Konica Minolta Holdings Inc, et al.
JP2004114675 Machine Translation (by EPO and Google)—published Apr. 15, 2004; Canon Inc.
JP2004148687A Machine Translation (by EPO and Google)—published May 27, 2014; Mitsubishi Heavy Ind Ltd.
JP2004231711 Machine Translation (by EPO and Google)—published Aug. 19, 2004; Seiko Epson Corp.
JP2004261975 Machine Translation (by EPO, PlatPat and Google); published on Sep. 24, 2004, Seiko Epson Corp, Kataoka et al.
JP2004325782A Machine Translation (by EPO and Google)—published Nov. 18, 2004; Canon KK.
JP2004524190A Machine Translation (by EPO and Google)—published Aug. 12, 2004; Avery Dennison Corp.
JP2005014255 Machine Translation (by EPO and Google)—published Jan. 20, 2005; Canon Inc.
JP2005014256 Machine Translation (by EPO and Google)—published Jan. 20, 2005; Canon Inc.
JP2005114769 Machine Translation (by PlatPat English machine translation)—published Apr. 28, 2005 Ricoh KK.
JP2005215247A Machine Translation (by EPO and Google)—published Aug. 11, 2005; Toshiba Corp.
JP2005319593 Machine Translation (by EPO and Google)—published Nov. 17, 2005, Jujo Paper Co Ltd.
JP2006001688 Machine Translation (by PlatPat English machine translation)—published Jan. 5, 2006 Ricoh KK.
JP2006023403A Machine Translation (by EPO and Google)—published Jan. 26, 2006; Ricoh KK.
JP2006095870A Machine Translation (by EPO and Google)—published Apr. 13, 2006; Fuji Photo Film Co Ltd.
JP2006102975 Machine Translation (by EPO and Google)—published Apr. 20, 2006; Fuji Photo Film Co Ltd.
JP2006137127 Machine Translation (by EPO and Google)—published Jun. 1, 2006; Konica Minolta Med & Graphic.
JP2006143778 Machine Translation (by EPO, PlatPat and Google)—published Jun. 8, 2006 Sun Bijutsu Insatsu KK et al.
JP2006152133 Machine Translation (by EPO, PlatPat and Google)—published Jun. 15, 2006 Seiko Epson Corp.
JP2006224583A Machine Translation (by EPO and Google)—published Aug. 31, 2006; Konica Minolta Holdings Inc.
JP2006231666A Machine Translation (by EPO and Google)—published Sep. 7, 2006; Seiko Epson Corp.
JP2006234212A Machine Translation (by EPO and Google)—published Sep. 7, 2006; Matsushita Electric Ind Co Ltd.
JP2006243212 Machine Translation (by PlatPat English machine translation)—published Sep. 14, 2006 Fuji Xerox Co Ltd.
JP2006263984 Machine Translation (by EPO, PlatPat and Google)—published Oct. 5, 2006 Fuji Photo Film Co Ltd.
JP2006347081 Machine Translation (by EPO and Google)—published Dec. 28, 2006; Fuji Xerox Co Ltd.
JP2006347085 Machine Translation (by EPO and Google)—published Dec. 28, 2006 Fuji Xerox Co Ltd.
JP2007025246A Machine Translation (by EPO and Google)—published Feb. 1, 2007; Seiko Epson Corp.
JP2007041530A Machine Translation (by EPO and Google)—published Feb. 15, 2007; Fuji Xerox Co Ltd.
JP2007069584 Machine Translation (by EPO and Google)—published Mar. 22, 2007 Fujifilm.
JP2007083445A Machine Translation (by EPO and Google)—published Apr. 5, 2007; Fujifilm Corp.
JP2007216673 Machine Translation (by EPO and Google)—published Aug. 30, 2007 Brother Ind.
JP2007253347A Machine Translation (by EPO and Google)—published Oct. 4, 2007; Ricoh KK, Matsuo et al.
JP2008006816 Machine Translation (by EPO and Google)—published Jan. 17, 2008; Fujifilm Corp.
JP2008018716 Machine Translation (by EPO and Google)—published Jan. 31, 2008; Canon Inc.
JP2008137239A Machine Translation (by EPO and Google); published on Jun. 19, 2008, Kyocera Mita Corp.
JP2008139877A Machine Translation (by EPO and Google)—published Jun. 19, 2008; Xerox Corp.
JP2008142962 Machine Translation (by EPO and Google)—published Jun. 26, 2008; Fuji Xerox Co Ltd.
JP2008183744A Machine Translation (by EPO and Google)—published Aug. 14, 2008, Fuji Xerox Co Ltd.
JP2008194997A Machine Translation (by EPO and Google)—published Aug. 28, 2008; Fuji Xerox Co Ltd.
JP2008201564 Machine Translation (English machine translation)—published Sep. 4, 2008 Fuji Xerox Co Ltd.
JP2008238674A Machine Translation (by EPO and Google)—published Oct. 9, 2008; Brother Ind Ltd.
JP2008246990 Machine Translation (by EPO and Google)—published Oct. 16, 2008, Jujo Paper Co Ltd.
JP2008254203A Machine Translation (by EPO and Google)—published Oct. 23, 2008; Fujifilm Corp.
JP2008255135 Machine Translation (by EPO and Google)—published Oct. 23, 2008; Fujifilm Corp.
JP2009045794 Machine Translation (by EPO and Google)—published Mar. 5, 2009; Fujifilm Corp.

(56) References Cited

OTHER PUBLICATIONS

JP2009045851A Machine Translation (by EPO and Google); published on Mar. 5, 2009, Fujifilm Corp.
JP2009045885A Machine Translation (by EPO and Google)—published Mar. 5, 2009; Fuji Xerox Co Ltd.
JP2009083314 Machine Translation (by EPO, PlatPat and Google)—published Apr. 23, 2009 Fujifilm Corp.
JP2009083317 Abstract; Machine Translation (by EPO and Google)—published Apr. 23, 2009; Fuji Film Corp.
JP2009083325 Abstract; Machine Translation (by EPO and Google)—published Apr. 23, 2009 Fujifilm.
JP2009096175 Machine Translation (EPO, PlatPat and Google) published on May 7, 2009 Fujifilm Corp.
JP2009148908A Machine Translation (by EPO and Google)—published Jul. 9, 2009; Fuji Xerox Co Ltd.
JP2009154330 Machine Translation (by EPO and Google)—published Jul. 16, 2009; Seiko Epson Corp.
JP2009190375 Machine Translation (by EPO and Google)—published Aug. 27, 2009; Fuji Xerox Co Ltd.
JP2009202355 Machine Translation (by EPO and Google)—published Sep. 10, 2009; Fuji Xerox Co Ltd.
JP2009214318 Machine Translation (by EPO and Google)—published Sep. 24, 2009 Fuji Xerox Co Ltd.
JP2009214439 Machine Translation (by PlatPat English machine translation)—published Sep. 24, 2009 Fujifilm Corp.
JP2009226852 Machine Translation (by EPO and Google)—published Oct. 8, 2009; Hirato Katsuyuki, Fujifilm Corp.
JP2009233977 Machine Translation (by EPO and Google)—published Oct. 15, 2009; Fuji Xerox Co Ltd.
JP2009234219 Machine Translation (by EPO and Google)—published Oct. 15, 2009; Fujifilm Corp.
JP2010054855 Machine Translation (by PlatPat English machine translation)—published Mar. 11, 2010 Itatsu, Fuji Xerox Co.
JP2010105365 Machine Translation (by EPO and Google)—published May 13, 2010; Fuji Xerox Co Ltd.
JP2010173201 Abstract; Machine Translation (by EPO and Google)—published Aug. 12, 2010; Richo Co Ltd.
JP2010184376 Machine Translation (by EPO, PlatPat and Google)—published Aug. 26, 2010 Fujifilm Corp.
JP2010214885A Machine Translation (by EPO and Google)—published Sep. 30, 2010; Mitsubishi Heavy Ind Ltd.
JP2010228192 Machine Translation (by PlatPat English machine translation)—published Oct. 14, 2010 Fuji Xerox.
JP2010228392A Machine Translation (by EPO and Google)—published Oct. 14, 2010; Jujo Paper Co Ltd.
JP2010234599A Machine Translation (by EPO and Google)—published Oct. 21, 2010; Duplo Seiko Corp et al.
JP2010234681A Machine Translation (by EPO and Google)—published Oct. 21, 2010; Riso Kagaku Corp.
JP2010241073 Machine Translation (by EPO and Google)—published Oct. 28, 2010; Canon Inc.
JP2010247381A Machine Translation (by EPO and Google); published on Nov. 4, 2010, Ricoh Co Ltd.
JP2010258193 Machine Translation (by EPO and Google)—published Nov. 11, 2010; Seiko Epson Corp.
JP2010260204A Machine Translation (by EPO and Google)—published Nov. 18, 2010; Canon KK.
JP2010260287 Machine Translation (by EPO and Google)—published Nov. 18, 2010, Canon KK.
JP2010260302A Machine Translation (by EPO and Google)—published Nov. 18, 2010; Riso Kagaku Corp.
JP2011002532 Machine Translation (by PlatPat English machine translation)—published Jun. 1, 2011 Seiko Epson Corp.
JP2011025431 Machine Translation (by EPO and Google)—published Feb. 10, 2011; Fuji Xerox Co Ltd.
JP2011037070A Machine Translation (by EPO and Google)—published Feb. 24, 2011; Riso Kagaku Corp.
JP2011067956A Machine Translation (by EPO and Google)—published Apr. 7, 2011; Fuji Xerox Co Ltd.
JP2011126031A Machine Translation (by EPO and Google); published on Jun. 30, 2011, Kao Corp.
JP2011144271 Machine Translation (by EPO and Google)—published Jun. 28, 2011 Toyo Ink SC Holdings Co Ltd.
JP2011173325 Abstract; Machine Translation (by EPO and Google)—published Sep. 8, 2011; Canon Inc.
JP2011173326 Machine Translation (by EPO and Google)—published Sep. 8, 2011; Canon Inc.
JP2011186346 Machine Translation (by PlatPat English machine translation)—published Sep. 22, 2011 Seiko Epson Corp, Nishimura et al.
JP2011189627 Machine Translation (by Google Patents)—published Sep. 29, 2011; Canon KK.
JP2011201951A Machine Translation (by PlatPat English machine translation); published on Oct. 13, 2011, Shin-Etsu Chemical Co Ltd, Todoroki et al.
JP2011224032 Machine Translation (by EPO & Google)—published Jul. 5, 2012 Canon KK.
JP2012086499 Machine Translation (by EPO and Google)—published May 10, 2012; Canon Inc.
JP2012111194 Machine Translation (by EPO and Google)—published Jun. 14, 2012; Konica Minolta.
JP2012196787A Machine Translation (by EPO and Google)—published Oct. 18, 2012; Seiko Epson Corp.
JP2012201419A Machine Translation (by EPO and Google)—published Oct. 22, 2012, Seiko Epson Corp.
JP2013001081 Machine Translation (by EPO and Google)—published Jan. 7, 2013; Kao Corp.
JP2013060299 Machine Translation (by EPO and Google)—published Apr. 4, 2013; Ricoh Co Ltd.
JP2013103474 Machine Translation (by EPO and Google)—published May 30, 2013; Ricoh Co Ltd.
JP2013121671 Machine Translation (by EPO and Google)—published Jun. 20, 2013; Fuji Xerox Co Ltd.
JP2013129158 Machine Translation (by EPO and Google)—published Jul. 4, 2013; Fuji Xerox Co Ltd.
JP2014047005A Machine Translation (by EPO and Google)—published Mar. 17, 2014; Ricoh Co Ltd.
JP2014094827A Machine Translation (by EPO and Google)—published May 22, 2014; Panasonic Corp.
JP2016185688A Machine Translation (by EPO and Google)—published Oct. 27, 2016; Hitachi Industry Equipment Systems Co Ltd.
JP2529651B2 Machine Translation (by EPO and Google)—issued Aug. 28, 1996;Osaka Sealing Insatsu KK.
JPH03248170A Machine Translation (by EPO & Google)—published Nov. 6, 1991; Fujitsu Ltd.
JPH05147208 Machine Translation (by EPO and Google)—published Jun. 15, 1993—Mita Industrial Co Ltd.
JPH06100807 Machine Translation (by EPO and Google)—published Apr. 12, 1994; Seiko Instr Inc.
JPH06171076A Machine Translation (by PlatPat English machine translation)—published Jun. 21, 1994, Seiko Epson Corp.
JPH06345284A Machine Translation (by EPO and Google); published on Dec. 20, 1994, Seiko Epson Corp.
JPH06954A Machine Translation (by EPO and Google)—published Jan. 11, 1994; Seiko Epson Corp.
JPH07186453A Machine Translation (by EPO and Google)—published Jul. 25, 1995; Toshiba Corp.
JPH07238243A Machine Translation (by EPO and Google)—published Sep. 12, 1995; Seiko Instr Inc.
JPH08112970 Machine Translation (by EPO and Google)—published May 7, 1996; Fuji Photo Film Co Ltd.
JPH0862999A Machine Translation (by EPO & Google)—published Mar. 8, 1996 Toray Industries, Yoshida, Tomoyuki.
JPH09123432 Machine Translation (by EPO and Google)—published May 13, 1997, Mita Industrial Co Ltd.
JPH09157559A Machine Translation (by EPO and Google)—published Jun. 17, 1997; Toyo Ink Mfg Co.
JPH09281851A Machine Translation (by EPO and Google)—published Oct. 31, 1997; Seiko Epson Corp.
JPH09314867A Machine Translation (by PlatPat English machine translation)—published Dec. 9, 1997, Toshiba Corp.

(56) References Cited

OTHER PUBLICATIONS

JPH11106081A Machine Translation (by EPO and Google)—published Apr. 20, 1999; Ricoh KK.
JPH11245383A Machine Translation (by EPO and Google)—published Sep. 14, 1999; Xerox Corp.
JPH5297737 Machine Translation (by EPO & Google machine translation)—published Nov. 12, 1993 Fuji Xerox Co Ltd.
JPS5578904A Machine Translation (by EPO and Google)—published Jun. 14, 1980; Yokoyama Haruo.
JPS57121446U Machine Translation (by EPO and Google)—published Jul. 28, 1982.
JPS60199692A Machine Translation (by EPO and Google)—published Oct. 9, 1985; Suwa Seikosha KK.
JPS6076343A Machine Translation (by EPO and Google)—published Apr. 30, 1985; Toray Industries.
JPS6223783A Machine Translation (by EPO and Google)—published Jan. 31, 1987; Canon KK.
Machine Translation (by EPO and Google) of JPH07112841 published on May 2, 1995 Canon KK.
Marconi Studios, Virtual Set Real Time; http://www.marconistudios.il/pages/virtualset_en.php.
Montuori G.M., et al., "Geometrical Patterns for Diagrid Buildings: Exploring Alternative Design Strategies From the Structural Point of View," Engineering Structures, Jul. 2014, vol. 71, pp. 112-127.
"Solubility of Alcohol", in http://www.solubilityoflhings.com/water/alcohol; downloaded on Nov. 30, 2017.
Poly(vinyl acetate) data sheet. PolymerProcessing.com. Copyright 2010. http://polymerprocessing .com/polymers/PV AC.html.
Royal Television Society, The Flight of the Phoenix; https://rts.org.uk/article/flight-phoenix, Jan. 27, 2011.
RU2180675C2 Machine Translation (by EPO and Google)—published Mar. 20, 2002; Zao Rezinotekhnika.
RU2282643C1 Machine Translation (by EPO and Google)—published Aug. 27, 2006; Balakovorezinotekhnika AOOT.
Technical Information Lupasol Types, Sep. 2010, 10 page.
The Engineering Toolbox., "Dynamic Viscosity of Common Liquids," 2018, 4 pages.
Thomas E. F., "CRC Handbook of Food Additives, Second Edition, vol. 1" CRC Press LLC, 1972, p. 434.
Units of Viscosity published by Hydramotion Ltd. 1 York Road Park, Malton, York Y017 6YA, England; downloaded from www.hydramotion.com website on Jun. 19, 2017.
WO2006051733A1 Machine Translation (by EPO and Google)—published May 18, 2006; Konica Minolta Med & Graphic.
WO2010073916A1 Machine Translation (by EPO and Google)—published Jul. 1, 2010; Nihon Parkerizing [JP] et al.
WO2013087249 Machine Translation (by EPO and Google)—published Jun. 20, 2013; Koenig & Bauer AG.

* cited by examiner

ENDLESS FLEXIBLE BELT FOR A PRINTING SYSTEM

FIELD AND BACKGROUND OF THE INVENTION

The present invention relates to an endless flexible belt for a printing system, and more specifically to an endless flexible belt including lateral formations which ensure the proper alignment and registration of the belt during printing. The endless belt of the invention finds particular application as an intermediate transfer member (ITM) in a printing system in which, instead of ink being applied directly onto a substrate, the desired image is formed by ink deposition (e.g. ink jetted droplets) on the intermediate transfer member, the latter then serving to transport the image to an impression station at which the image is impressed on a substrate.

Flexible belts for use as an ITM in a printing system are disclosed in Applicant's U.S. Pat. Nos. 9,290,016, 9,643,403 and 9,517,618.

SUMMARY OF THE INVENTION

Embodiments of the present invention relate to the construction and installation of a continuous flexible belt, suitable for use as an intermediate transfer member in a printing system, which belt is guided when in use, for instance over rollers.

In accordance with an embodiment of the present invention, there is provided an intermediate transfer member (ITM) for use in a printing system to transport ink images from an image forming station to an impression station for transfer of the ink image from the ITM onto a printing substrate, wherein the ITM includes:

an endless flexible belt having a uniform belt width, the endless flexible belt formed of an elongate belt having a longitudinal axis;

a first elongate strip and a second elongate strip, the first and second elongate strips attached to lateral edges of the belt along the longitudinal axis, the first and second elongate strips each including lateral formations on outward facing lateral ends thereof, the outward facing lateral ends being distal to the lateral edges of the belt, wherein, during use, the belt is configured to be guided by a guiding system through at least the image forming station, the guiding system including guide channels configured to receive the lateral formations, wherein at least one of the first and second elongate strips has a strip width and includes a first longitudinal portion extending along the longitudinal axis and having first portion width and a first elasticity, and a second longitudinal portion extending along the longitudinal axis and having a second portion width and a second elasticity, the first portion being attached to the lateral edges of the belt and the second portion extending between the first portion and the lateral formations, wherein the second elasticity is greater than the first elasticity.

In some embodiments, the lateral formations are configured to engage the guide channels, so that the belt is placed under tension in a width-ways direction perpendicular to the longitudinal axis, and is constrained to follow a continuous path defined by the guide channels.

In some embodiments, the second portion is elastic in a width-ways direction perpendicular to the longitudinal axis.

In some embodiments, the first portion width is in the range of 30% to 90% of the strip width. In some embodiments, a ratio between the first portion width and the strip width is in the range of 1:1.1 to 1:3. In some embodiments, the first portion width is in the range of 15 mm to 30 mm. In some embodiments, the first portion width is in the range of 15 mm to 20 mm In some embodiments, the second portion width is in the range of 10% to 90% of the strip width. In some embodiments, a ratio between the second portion width and the strip width is in the range of 1:1.1 to 1:10. In some embodiments, the second portion width is in the range of 2 mm to 15 mm. In some embodiments, the second portion width is in the range of 3 mm to 7 mm.

In some embodiments, a ratio between the second portion width and the first portion width is in the range of 1:1 to 1:15.

In some embodiments, a ratio between the strip width and the belt width is in the range of 1:25 to 1:47.

In some embodiments, a ratio between the first portion width and the belt width is in the range of 1:33.3 to 1:93.3. In some embodiments, a ratio between the second portion width and the belt width is in the range of 1:66.6 to 1:700.

In some embodiments, the strip width is in the range of 20 mm to 40 mm. In some embodiments, the belt width is in the range of 1000 mm to 1400 mm.

In some embodiments, the spring constant of the first portion, or the first elasticity, is at least 10.0, at least 20.0, at least 30.0, at least 40.0 at least 50.0 N/mm, at least 75.0, at least 100.0, at least 125.0, at least 150.0, at least 175.0, or at least 200.0 N/mm, when measured on a sample having a length of 10 mm and a width of 22 mm in the elastic direction. In some embodiments, the first elasticity is at most 5% elongation, at most 4% elongation, at most 3% elongation, at most 2% elongation, at most 1% elongation, at most 0.5% elongation, at most 0.2% elongation, or at most 0.1% elongation.

In some embodiments, the spring constant of the second portion, or the second elasticity is in the range of 0.1 to 10.0 N/mm, 0.1 to 8.0 N/mm, or 0.1 to 5.0 N/mm, 1.0 to 5.0 N/mm, 2.0 to 5.0 N/mm, or 3.0 to 5.0 N/mm, when measured on a sample having a length of 10 mm and a width of 22 mm in the elastic direction. In some embodiments, the second elasticity is at least 5% elongation, at least 8% elongation, or at least 10% elongation, at least 20% elongation, at least 30% elongation, at least 40% elongation, or at least 50% elongation.

In some embodiments, a ratio between spring constant measurements of the second elasticity and the first elasticity, when measured in N/mm on a sample having a sample width of 22 mm and a sample length of 10 mm, is at least 1:4, at least 1:6, at least 1:10, at least 1:12, at least 1:20, at least 1:30, at least 1:40, at least 1:50, at least 1:60, at least 1:70, at least 1:80, at least 1:90, or at least 1:100. In some embodiments, the spring constant ratio is in the range of 1:6 to 1:25.

In some embodiments, the first longitudinal portion is non-elastic, and the second longitudinal portion is elastic. In some embodiments, the first longitudinal portion is somewhat elastic, and the second longitudinal portion is more elastic.

In some embodiments, only the first elongate strip includes the first non-elastic portion and the second elastic portion, and wherein the second elongate strip is non-elastic.

In some embodiments, only the first elongate strip includes the first non-elastic portion and the second elastic portion, and wherein the second elongate strip is elastic.

In some embodiments, the first elongate strip and the second elongate strip each include a the first portion and a the second portion.

In some embodiments, an elasticity of the second portion of the first elongate strip is sufficient to maintain the belt taut when the lateral formations are guided through their respective guide channels.

In some embodiments, the lateral formations include longitudinally spaced formations disposed on each of the outward facing lateral ends of the first and second elongate strips. In some embodiments, at least one of the first and the second elongate strips includes one half of a zip fastener, and wherein the longitudinally spaced formations include teeth of the one half of the zip fastener. In some embodiments, the first elongate strip and the second elongate strip include two complementary portions of a single zip fastener.

In some embodiments, the lateral formations include a continuous flexible bead disposed on each of the outward facing lateral ends of the first and second elongate strips.

In some embodiments, a maximal load applied to the at least one of the first and second elongate strips at a time of failure between the at least one of the first and second elongate strips and the belt is at least 50.0 N/mm.

In some embodiments, the belt comprises a support and a release layer, the support layer is made of a fabric that is fiber-reinforced at least in the longitudinal direction of the belt, the fiber being a high performance fiber selected from the group comprising aramid, carbon, ceramic, and glass fibers. In some embodiments, the release layer has a hydrophobic outer surface. In some embodiments, the belt additionally comprises a compressible layer.

In some embodiments, the endless flexible belt is formed from a flat elongate strip, ends of which are configured to be secured to one another at a seam to form a continuous loop. In some embodiments, the belt includes one or more markings detectable by a sensor of the printing system.

In accordance with an embodiment of the present invention, there is provided a method of forming a flexible belt, the method including:

a. obtaining an elongate flexible belt having a uniform belt width and a longitudinal axis, the belt being suitable for use as an ITM in a printing system, the elongate flexible belt having first and second lateral edges;

b. obtaining a first elongate strip having a strip width and including:

- a first longitudinal portion extending along the longitudinal axis and having a first portion width and a first elasticity, the first longitudinal portion extending along the first elongate strip at a first lateral end thereof;
- lateral formations on a second lateral end of the first elongate strip; and
- a second longitudinal portion extending along the longitudinal axis and having a second portion width and a second elasticity, the second longitudinal portion extending longitudinally between the first portion and the lateral formations,
- wherein the second elasticity is greater than the first elasticity; and c. obtaining a second elongate strip having first and second lateral ends, and including lateral formations on the second lateral end thereof.

In some embodiments, the method further includes attaching the second lateral ends of the first and second elongate strips to the first and second lateral edges of the elongate flexible belt.

In accordance with an embodiment of the present invention, there is provided a printing system including:

a. an intermediate transfer member (ITM) including:

- (i) an endless flexible belt having a uniform belt width, the endless flexible belt formed of an elongate belt having a longitudinal axis;
- (ii) a first elongate strip and a second elongate strip, each attached to lateral edges of the belt along the longitudinal axis, the first and second elongate strips each including lateral formations on outward facing lateral ends thereof, the outward facing lateral ends being distal to the lateral edges of the belt,
  - wherein at least one of the first and second elongate strips has a strip width and includes a first longitudinal portion having a first portion width and a first elasticity, and a second longitudinal portion having a second portion width and a second elasticity, the first portion being attached to the lateral edges of the belt and the second portion extending between the first portion and the lateral formations,
  - wherein the second elasticity is greater than the first elasticity;

b. an image forming station at which droplets of ink are applied to an outer surface of the ITM to form ink images thereon;

c. an impression station for transfer of the ink images from the ITM onto a printing substrate; and d. a guiding system including guide channels configured to receive the lateral formations, the guiding system extending at least through the image forming station and configured, during use, to guide the ITM along the image forming station.

In some embodiments, the guiding system is further configured to guide the ITM through the impression station. In some embodiments, the guide channels further include rolling bearings, and wherein the lateral formations of the ITM are retained within the guide channels by the rolling bearings.

In some embodiments, the engagement between the lateral formations and the guide channels places the belt under tension in a width-ways direction perpendicular to the longitudinal axis, such that the belt is constrained to follow a continuous path defined by the guide channels.

In some embodiments, the second portion is elastic in a width-ways direction perpendicular to the longitudinal axis.

In some embodiments, the first portion width is in the range of 30% to 90% of the strip width. In some embodiments, a ratio between the first portion width and the strip width is in the range of 1:1.1 to 1:3. In some embodiments, the first portion width is in the range of 15 mm to 30 mm. In some embodiments, the first portion width is in the range of 15 mm to 20 mm.

In some embodiments, the second portion width is in the range of 10% to 90% of the strip width. In some embodiments, a ratio between the second portion width and the strip width is in the range of 1:1.1 to 1:10. In some embodiments, the second portion width is in the range of 2 mm to 15 mm. In some embodiments, the second portion width is in the range of 3 mm to 7 mm.

In some embodiments, a ratio between the second portion width and the first portion width is in the range of 1:1 to 1:15.

In some embodiments, a ratio between the strip width and the belt width is in the range of 1:25 to 1:47.

In some embodiments, a ratio between the first portion width and the belt width is in the range of 1:33.3 to 1:93.3. In some embodiments, a ratio between the second portion width and the belt width is in the range of 1:66.6 to 1:700.

In some embodiments, the strip width is in the range of 20 mm to 40 mm. In some embodiments, the belt width is in the range of 1000 mm to 1400 mm.

In some embodiments, the spring constant of the first portion, or the first elasticity, is at least 10.0, at least 20.0, at least 30.0, at least 40.0 at least 50.0 N/mm, at least 75.0, at least 100.0, at least 125.0, at least 150.0, at least 175.0, or at least 200.0 N/mm, when measured on a sample having a length of 10 mm and a width of 22 mm in the elastic direction. In some embodiments, the first elasticity is at most 5% elongation, at most 4% elongation, at most 3% elongation, at most 2% elongation, at most 1% elongation, at most 0.5% elongation, at most 0.2% elongation, or at most 0.1% elongation.

In some embodiments, the spring constant of the second portion, or the second elasticity is in the range of 0.1 to 10.0 N/mm, 0.1 to 8.0 N/mm, or 0.1 to 5.0 N/mm, 1.0 to 5.0 N/mm, 2.0 to 5.0 N/mm, or 3.0 to 5.0 N/mm, when measured on a sample having a length of 10 mm and a width of 22 mm in the elastic direction. In some embodiments, the second elasticity is at least 5% elongation, at least 8% elongation, or at least 10% elongation, at least 20% elongation, at least 30% elongation, at least 40% elongation, or at least 50% elongation.

In some embodiments, a ratio between spring constant measurements of the second elasticity and the first elasticity, when measured in N/mm on a sample having a sample width of 22 mm and a sample length of 10 mm, is at least 1:4, at least 1:6, at least 1:10, at least 1:12, at least 1:20, at least 1:30, at least 1:40, at least 1:50, at least 1:60, at least 1:70, at least 1:80, at least 1:90, or at least 1:100. In some embodiments, the spring constant ratio is in the range of 1:6 to 1:25.

In some embodiments, the first longitudinal portion is non-elastic, and the second longitudinal portion is elastic.

In some embodiments, only the first elongate strip includes the first non-elastic portion and the second elastic portion, and wherein the second elongate strip is non-elastic.

In some embodiments, only the first elongate strip includes the first non-elastic portion and the second elastic portion, and wherein the second elongate strip is elastic.

In some embodiments, the first elongate strip and the second elongate strip each include the first portion and the second portion.

In some embodiments, an elasticity of the second portion of the first elongate strip is sufficient to maintain the belt taut when the lateral formations are guided through the guide channels.

In some embodiments, the lateral formations include longitudinally spaced formations disposed on each of the outward facing lateral ends of the first and second elongate strips. In some embodiments, at least one of the first and the second elongate strips includes one half of a zip fastener, and wherein the longitudinally spaced formations include teeth of the one half of the zip fastener. In some embodiments, the first elongate strip and the second elongate strip include two complementary portions of a single zip fastener.

In some embodiments, the lateral formations include a continuous flexible bead disposed on each of the outward facing lateral ends of the first and second elongate strips.

In some embodiments, a maximal load applied to the at least one of the first and second elongate strips at a time of failure between the at least one of the first and second elongate strips and the belt is at least 50.0 N/mm.

In some embodiments, the belt includes a support and a release layer, and the support layer is made of a fabric that is fiber-reinforced at least in the longitudinal direction of the belt, the fiber being a high performance fiber selected from the group comprising aramid, carbon, ceramic, and glass fibers.

In some embodiments, the release layer has a hydrophobic outer surface.

In some embodiments, the belt additionally includes a compressible layer.

In some embodiments, the endless flexible belt is formed from a flat elongate strip, ends of which are configured to be secured to one another at a seam to form a continuous loop.

In some embodiments, the belt includes one or more markings detectable by a sensor of the printing system.

In accordance with an embodiment of the present invention, there is provided an elongate strip including:

a first non-elastic portion extending along the first elongate strip at a first lateral end thereof;

lateral formations on a second lateral end of the first elongate strip; and a second, elastic portion, extending and between the first non-elastic portion and the lateral formations.

In accordance with an embodiment of the present invention, there is provided a method of forming the elongate strip described herein, the method including:

weaving an elongate flexible strip;

impregnating a first portion of the elongate flexible strip with at least one of silicone and liquid rubber, so as to form the first, non-elastic portion; and forming the lateral formations on a lateral edge of the elongate flexible strip distal to the first portion, thereby to form the elongate strip.

In accordance with an embodiment of the present invention, there is provided a method of forming the elongate strip described herein, the method including:

weaving an elongate flexible strip;

laminating a stiff film onto a first portion of the elongate flexible strip so as to form the first, non-elastic portion; and forming the lateral formations on a lateral edge of the elongate flexible strip distal to the first portion, thereby to form the elongate strip.

In accordance with an embodiment of the present invention, there is provided a method of forming the elongate strip described herein, the method including:

weaving an elongate strip wherein longitudinal threads of the weave include non-elastic threads, and wherein transverse threads of the weave include elastic threads having a first portion coated with a non-elastic coating, wherein an area woven with the first portion of the transverse threads is the first non-elastic portion of the elongate strip;

thermally fixing the elongate strip; and forming the lateral formations on a lateral edge of the elongate flexible strip distal to the first portion, thereby to form the elongate strip.

BRIEF DESCRIPTION OF THE DRAWINGS

The invention will now be described further, by way of example, with reference to the accompanying drawings, in which the dimensions of components and features shown in the figures are chosen for convenience and clarity of presentation and not necessarily to scale. In the drawings.

DESCRIPTION OF SOME EMBODIMENTS OF THE INVENTION

Figure 1:
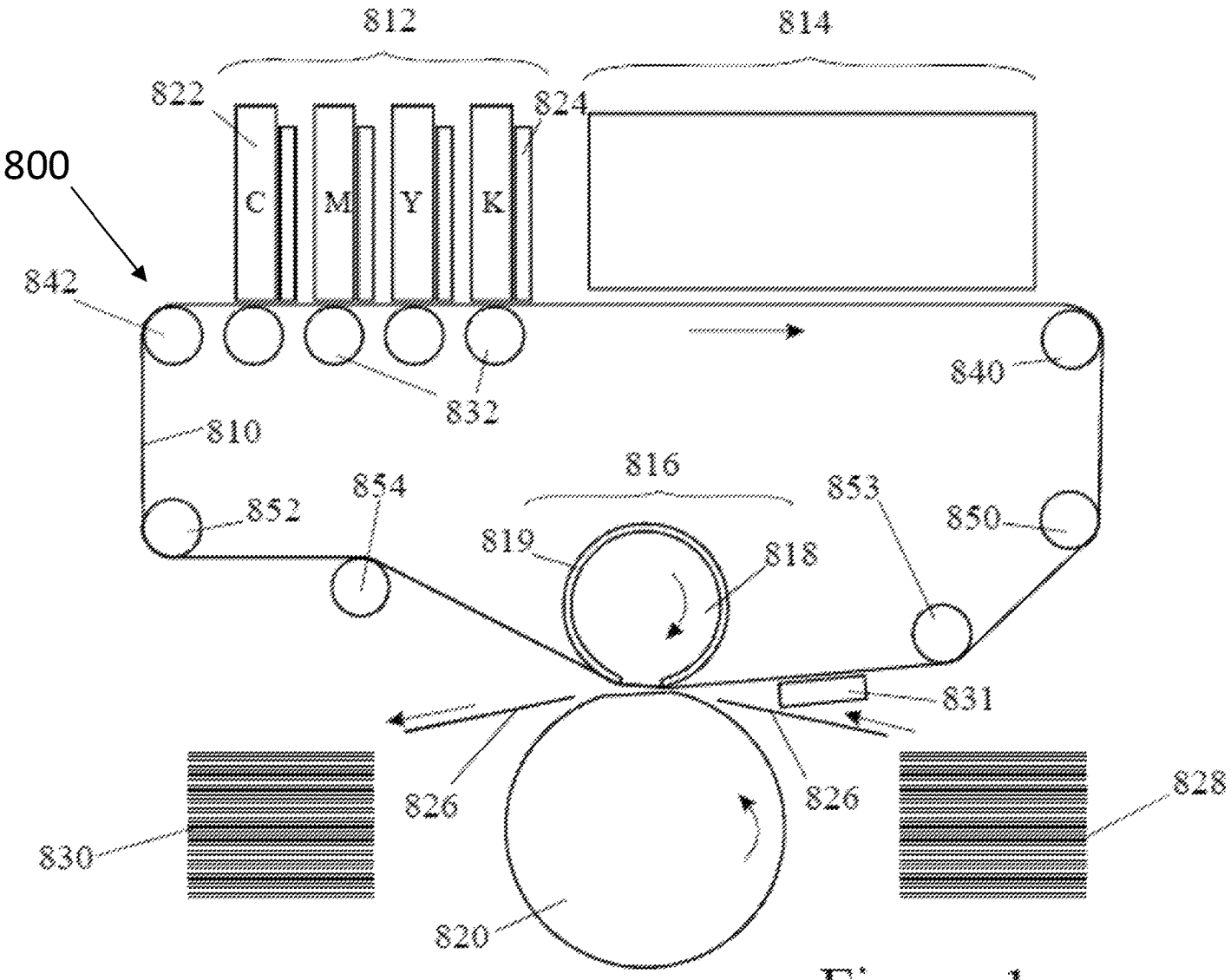
FIG. 1 is a schematic representation of one example of a printing system of the invention.

The invention, in some embodiments, relates to an endless flexible belt which may form an endless belt to be used as an ITM suitable for use with indirect printing systems.

The invention, in some embodiments, relates to an elongate strip connectable to the endless flexible belt or forming part thereof, which strip includes along an elongate lateral end thereof lateral formations which may be used to guide the endless flexible belt in a printing system, as well as two longitudinal portions each having a different elasticity, such that a portion of the strip connected to the endless flexible belt is less elastic than a portion of the strip distal to the endless flexible belt and connected to the lateral formations. The invention, in some embodiments, relates to a method for forming an ITM from a flexible belt and the elongate strip of the invention.

The present invention is intended to solve problems arising when using prior art methods of guiding the flexible elongate belt through the printing system.

In some existing printing systems, an elastic elongate strip having lateral formations thereon is attached to each of the lateral edges of a flexible belt, and the lateral formations are guided through guiding tracks of the printing system, thereby to form an ITM. However, when force is applied to the elastic strip, for example due to changes in the distance between the guiding tracks, the entirety of the elastic strip stretches, and because the elastic strip is connected directly to the flexible belt, this causes pulling or warping of the flexible belt as well. Additionally, force applied to the elastic strip causes pulling or stretching of the elastic strip also at the section thereof which is connected to the flexible belt, which may result in failure of the connection between the flexible belt and the elastic strip.

The present invention solves the deficiencies of existing belts by creating in the elongate strip including the lateral formations two longitudinal portions. One of these portions, which is less elastic, and in some cases is non-elastic, is attached to the flexible belt, and the other portion, which is more elastic, is adjacent the lateral formations. As such, the elongation of the more elastic portion has less impact on, and in some embodiments is completely separate from and has no impact on, the flexible belt, resulting in reduced warping of the flexible belt and in reduced failure of the connection between the flexible belt and the elongate strip, as explained in further detail hereinbelow.

The principles, uses and implementations of the teachings herein may be better understood with reference to the accompanying description and figures. Upon perusal of the description and figures present herein, one skilled in the art is able to implement the invention without undue effort or experimentation. In the figures, like reference numerals refer to like parts throughout.

Before explaining at least one embodiment in detail, it is to be understood that the invention is not necessarily limited in its application to the details of construction and the arrangement of the components and/or methods set forth herein. The invention is capable of other embodiments or of being practiced or carried out in various ways. The phraseology and terminology employed herein are for descriptive purposes and should not be regarded as limiting.

Additional objects, features and advantages of the invention will be set forth in the detailed description which follows, and in part will be readily apparent to those skilled in the art from the description or recognized by practicing the invention as described in the written description and claims hereof, as well as the appended drawings. Various features and sub-combinations of embodiments of the invention may be employed without reference to other features and sub-combinations.

It is to be understood that both the foregoing general description and the following detailed description, including the materials, methods and examples, are merely exemplary of the invention, and are intended to provide an overview or framework to understanding the nature and character of the invention as it is claimed, and are not intended to be necessarily limiting.

As known in the art, the elasticity of a material can be approximated as a spring constant k. In the linear-elastic range of a material, k is the factor characteristic of the elastic body setting the relation between the force F needed to extend the material and the distance X of extension resulting from such force. This can be mathematically represented by F=k*X, the force F being typically expressed in newtons (N or kg·m/s2), the distance X in meters (m) and the spring constant k in newtons per meter (N/m). The spring constant may vary as a function of temperature and as a function of time, as some materials may for instance loose stiffness under prolonged tensioning. However, above a certain load a material may be deformed to the extent its behavior is no longer in the linear elastic range.

In the context of the description and claims herein, the term "non-elastic" relates to a material having an elasticity of at most 5% elongation, at most 4% elongation, at most 3% elongation, or at most 2% elongation, or to a material which, when measured on a sample having a 22 mm width in the direction of elastic stretching and a 10 mm length, has a spring constant of at least 20.0 N/mm, at least 50.0 N/mm, at least 60.0 N/mm, at least 80.0 N/mm, at least 100.0 N/mm, at least 125.0 N/mm, at least 150.0 N/mm, at least 175.0 N/mm, or at least 200.0 N/mm.

In the context of the description and claims herein, the term "elastic" relates to a material having an elasticity of at least 5% elongation, at least 8% elongation, at least 10% elongation, at least 20% elongation, at least 30% elongation, at least 40% elongation, or at least 50% elongation, or to a material which, when measured on a sample having a 22 mm width in the direction of elastic stretching and a 10 mm length, has a spring constant of at most 10.0 N/mm, at most 8.0 N/mm, at most 5.0 N/mm, at most 3.0 N/mm, at most 1.0 N/mm, at most 0.8 N/mm, at most 0.5 N/mm, at most 0.2 N/mm, or at most 0.1 N/mm.

In the context of the description and claims herein, the term "X % elongation" relates to a percentage of elongation of the material resulting from strain in the elastic range of the material.

Reference is now made to FIG. 1, which is a schematic representation of a printing system of the invention. The printing system 800 of FIG. 1 comprises an ITM formed of an endless belt 810 that cycles through an image forming station 812, a drying station 814, and an impression station 816.

In the image forming station 812 four separate print bars 822 incorporating one or more print heads, that use inkjet technology, deposit aqueous ink droplets of different colors onto the surface of the belt 810. Though the illustrated embodiment has four print bars each able to deposit one of the typical four different colors (namely Cyan (C), Magenta (M), Yellow (Y) and Black (K)), it is possible for the image forming station to have a different number of print bars and for the print bars to deposit different shades of the same color (e.g. various shades of grey including black) or for two print bars or more to deposit the same color (e.g. black). Following each print bar 822 in the image forming station, an intermediate drying system 824 is provided to blow hot gas (usually air) onto the surface of the belt 810 to dry the ink droplets at least partially, to leave a tacky film having the ability to adhere to the substrate when transferred thereonto in the impression station.

In the impression station 816, the belt 810 passes between an impression cylinder 820 and a pressure cylinder 818 that carries a compressible blanket 819. Sheets 826 of substrate are carried by a suitable transport mechanism (not shown in FIG. 1) from a supply stack 828 and passed through the nip between the impression cylinder 820 and the pressure cylinder 818. Within the nip, the surface of the belt 810 carrying the ink image, is pressed firmly by the blanket 819 on the pressure cylinder 818 against the substrate 826 so that the ink image is impressed onto the substrate and separated neatly from the surface of the belt. The substrate is then transported to an output stack 830.

Belt 810 typically includes multiple layers, one of which is a hydrophobic release layer, as described, for example, in WO 2013/132418, which is herein incorporated by reference in its entirety.

As explained in further detail hereinbelow with respect to FIGS. 2A to 4, the lateral edges of the belt 810 are provided with lateral formations which are received in a respective guide channel in order to maintain the belt taut in its width-ways dimension. As explained in detail hereinbelow, the formations 110 may be the teeth of one half of a zip fastener that is sewn or otherwise secured to the lateral edge of the belt, or may be a continuous flexible bead of greater thickness than the belt 810 may be provided along each side.

The method used for mounting the belt 810 within the guide channels is described in detail in U.S. Pat. Nos. 9,290,016, 9,643,403 and 9,517,618.

As described in U.S. Pat. Nos. 9,290,016, 9,643,403 and 9,517,618 which are hereby incorporated by reference in their entirety, it is important for the belt 810 to move with constant speed through the image forming station 812 as any hesitation or vibration will affect the registration of the ink droplets of different colors. To assist in guiding the belt smoothly, friction is reduced by passing the belt over rollers 832 adjacent each printing bar 822 instead of sliding the belt over stationary guide plates. Other guiding rollers of the system ensure that the belt is maintained in a desired orientation along the printing cycle.

It is possible for the belt 810 to be seamless, that is it to say without discontinuities anywhere along its length. However, the belt may be formed as an initially flat strip of which the opposite ends are secured to one another, for example by a zip fastener or possibly by a strip of hook and loop tape or possibly by soldering the edges together or possibly by using tape (e.g. Kapton® tape, RTV liquid adhesives or PTFE thermoplastic adhesives with a connective strip overlapping both edges of the strip), as described in the patents mentioned hereinabove.

Figure 2A:
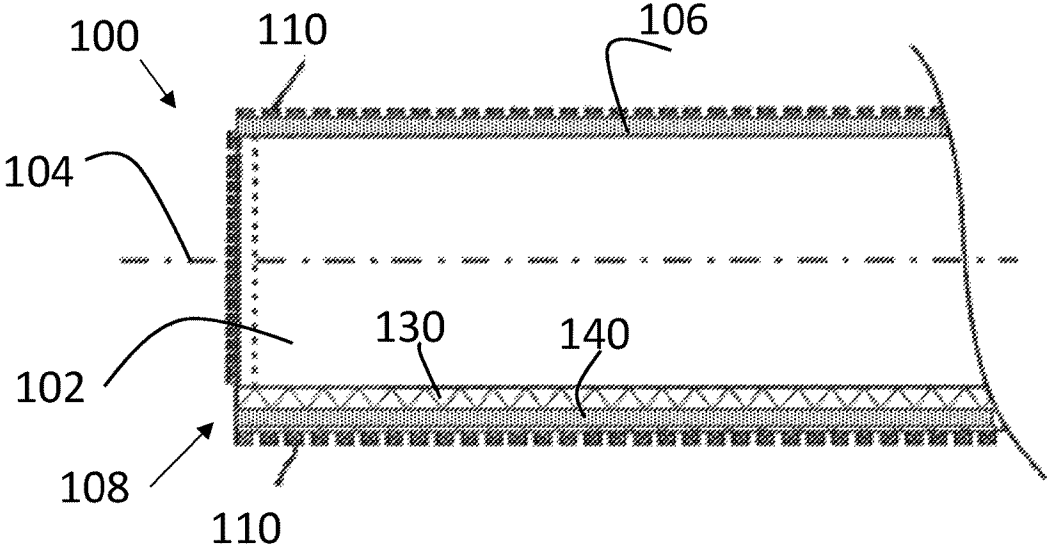
FIGS. 2A, 2B, and 2C are schematic plan view illustrations of three embodiments of a portion of an ITM suitable for use in the system of FIG. 1, according to embodiments of the teachings herein.
Figure 2B:
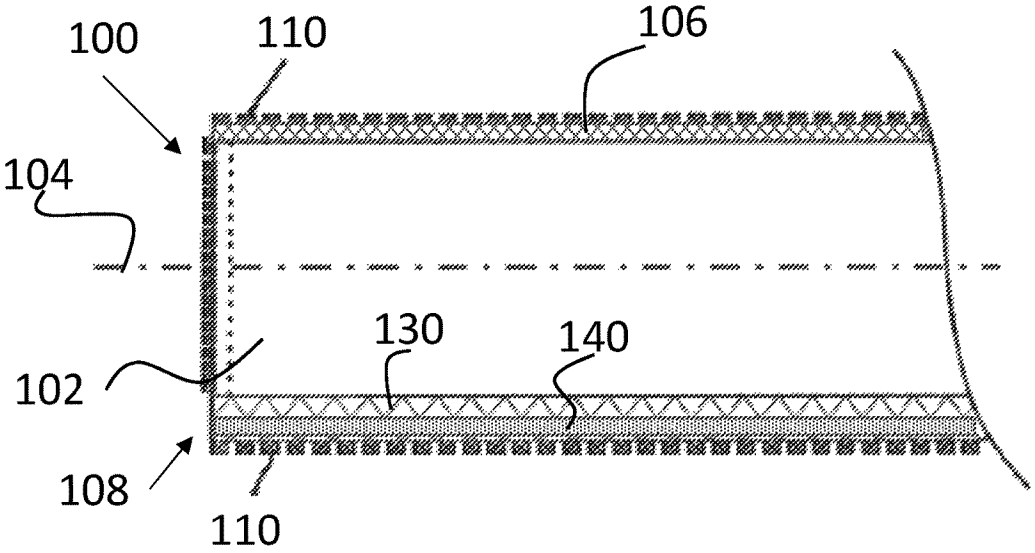
Figure 2C:
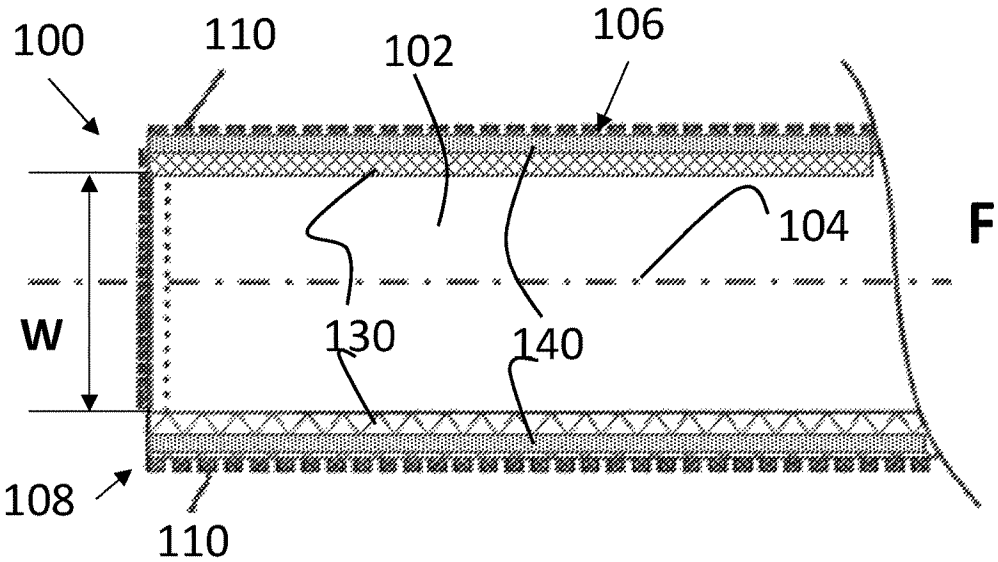

Reference is now made to FIGS. 2A, 2B, and 2C, which are schematic plan view illustrations of three embodiments of a portion of an ITM according to embodiments of the teachings herein.

As seen in FIGS. 2A to 2C, an ITM 100, suitable for use in a printing system such as the printing system 800 of FIG. 1, includes an endless flexible belt 102 having a uniform belt width and formed of an elongate belt having a longitudinal axis 104.

Attached to lateral edges of endless flexible belt 102, and arranged along longitudinal axis 104, are a first elongate strip 106 and a second elongate strip 108, each including lateral formations 110 disposed on outward facing lateral ends of the strip, distal to belt 102.

Figure 3:
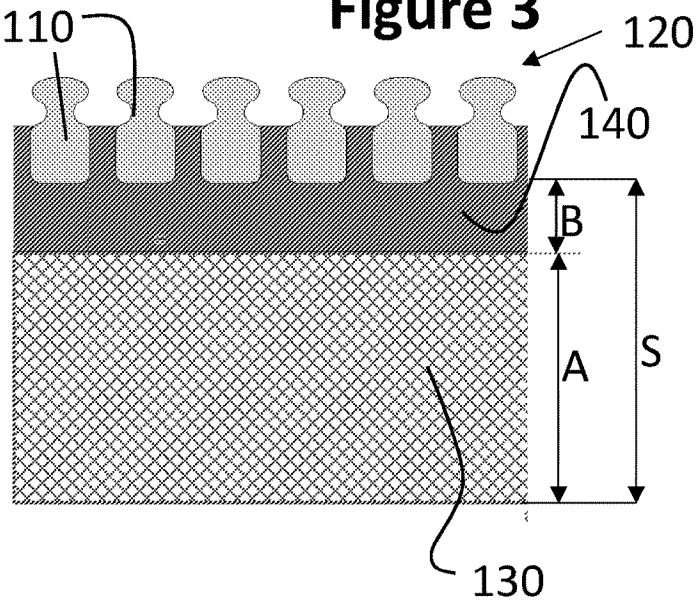
FIG. 3 is a plan view of a portion of an elongate strip forming part of each of the ITMs of FIGS. 2A to 2C, the elongate strip including lateral formations for guiding the ITM, the elongate strip including first and second longitudinal portions according to an embodiment of the teachings herein.

In accordance with the present invention, at least one of first elongate strip 106 and second elongate strip 108 is a strip 120 as shown in FIG. 3, which includes a first longitudinal portion 130 extending along the longitudinal axis and having a first elasticity, and a second longitudinal portion 140 extending along the longitudinal axis and having a second elasticity, such that the second elasticity is greater than the first elasticity.

As seen in FIGS. 2A to 2C, the first longitudinal portion 130 is attached to the lateral edge or edges of the belt 102, and the second longitudinal portion 140 extends between the first longitudinal portion 130 and the lateral formations 110.

In some embodiments, the second longitudinal portion 140 is elastic in a width-ways direction thereof, perpendicular to the longitudinal axis 104.

In some embodiments, the spring constant representing the first elasticity of first longitudinal portion 130 is at least 10.0, at least 20.0, at least 30.0, at least 40.0, at least 50.0, at least 75.0, at least 100.0, at least 125.0, at least 150.0, at least 175.0, or at least 200.0 N/mm, when measured on a sample having a length of 10 mm and a width of 22 mm in the elastic direction. In some embodiments, the spring constant representing the first elasticity of first longitudinal portion 130 is in the range of 30.0 to 80.0 N/mm, when measured on a sample having a length of 10 mm and a width of 22 mm in the elastic direction.

In some embodiments, the first elasticity of first longitudinal portion 130 is at most 5% elongation, at most 4% elongation, at most 3% elongation, at most 2% elongation, at most 1% elongation, at most 0.5% elongation, at most 0.2% elongation, or at most 0.1% elongation.

In some embodiments, the spring constant representing the second elasticity of second longitudinal portion 140 is in the range of 0.1 to 10.0 N/mm, 0.1 to 8.0 N/mm, or 0.1 to 5.0 N/mm, 1.0 to 5.0 N/mm, 2.0 to 5.0 N/mm, or 3.0 to 5.0 N/mm when measured on a sample having a length of 10 mm and a width of 22 mm in the elastic direction. In some embodiments, the second elasticity of second longitudinal portion 140 is at least 5% elongation, at least 8% elongation, at least 10% elongation, at least 20% elongation, at least 30% elongation, at least 40% elongation, or at least 50% elongation.

In some embodiments, a ratio between spring constant measurements of the second elasticity of second portion 140 and the first elasticity of first portion 130, when measured in N/mm on a sample having a sample width of 22 mm and a sample length of 10 mm, is at least 1:4, at least 1:6, at least 1:10, at least 1:12, at least 1:20, at least 1:30, at least 1:40, at least 1:50, at least 1:60, at least 1:70, at least 1:80, at least 1:90, or at least 1:100. In some embodiments, the spring constant ratio is in the range of 1:6 to 1:25.

In some embodiments, the first longitudinal portion 130 is non-elastic, and the second longitudinal portion 140 is elastic.

As seen in FIG. 3, the first longitudinal portion has a first portion width, indicated by the letter A, the second longitudinal portion has a second portion width, indicated by the letter B, and the strip has a strip width indicated by the letter S.

In some embodiments, the first portion width A is in the range of 30% to 90% of the strip width S. In some embodiments, a ratio between the first portion width A and the strip width S is in the range of 1:1.1 to 1:3.

In some embodiments, the second portion width B is in the range of 10% to 90% of the strip width S. In some embodiments, a ratio between the second portion width B and the strip width S is in the range of 1:1.1 to 1:10.

In some embodiments, the first portion width A is in the range of 15 mm to 30 mm. In some embodiments, the first portion width A is in the range of 15 mm to 20 mm.

In some embodiments, the second portion width B is in the range of 2 mm to 30 mm. In some embodiments, the second portion width B is in the range of 3 mm to 7 mm.

In some embodiments, a ratio between the second portion width B and the first portion width A is in the range of 1:1 to 1:15.

As shown in FIG. 2A, the belt 102 has a belt width indicated by the letter W. In some embodiments, a ratio between the strip width S and the belt width W is in the range of 1:25 to 1:47. In some embodiments, a ratio between the first portion width A and the belt width W is in the range of 1:33.3 to 1:93.3. In some embodiments, a ratio between the second portion width B and the belt width W is in the range of 1:66.6 to 1:700.

In some embodiments, the strip width S is in the range of 20 mm to 40 mm. In some embodiments, the strip width S is in the range of 25 mm to 32 mm. In some embodiments, the belt width W is in the range of 1000 mm to 1400 mm.

In some embodiments, illustrated for example in FIG. 2A, the first elongate strip 106 is an elastic strip, and the second elongate strip 108 is a strip 120 as illustrated in FIG. 3.

In some embodiments, illustrated for example in FIG. 2B, the first elongate strip 106 is a non-elastic strip, and the second elongate strip 108 is a strip 120 as illustrated in FIG. 3.

In some embodiments, illustrated for example in FIG. 2C, both the first elongate strip 106 and the second elongate strip 108 are elongate strips 120 as illustrated in FIG. 3.

The ITMs of FIGS. 2A, 2B, and 2C, are formed by obtaining the elongate flexible belt 102 and the elongate strips 106 and 108, and connecting the elongate strips to opposite lateral ends of belt 102. The connection may be by any suitable connection means, including sewing, adhering, fastening, laminating, and the like.

In some embodiments, the lateral formations 110 may be longitudinally spaced formations or projections, such as the teeth of one half of a ZIP fastener, as illustrated in FIG. 3.

Alternatively, the lateral formations 110 may be a continuous flexible bead disposed on each of the outward facing lateral ends of the first and second elongate strips 106 and 108.

The elongate strips 106 and 108 are secured to belt 102 such that there is substantially no elasticity between the coupling of the elongate strips 106 and 108 to the belt. For example, the strips 106 and 108 may be sewn or otherwise directly attached to the edge of the blanket or a substantially inelastic coupling member may be used to couple the strips to the side of the belt 102. This ensures that the lateral position of the blanket does not vary with respect to the position of the image forming station, and any required change in the width of the ITM is obtained by stretching of the elastic second portion(s) 140 of elongate strip 106 and/or elongate strip 108.

Figure 4:
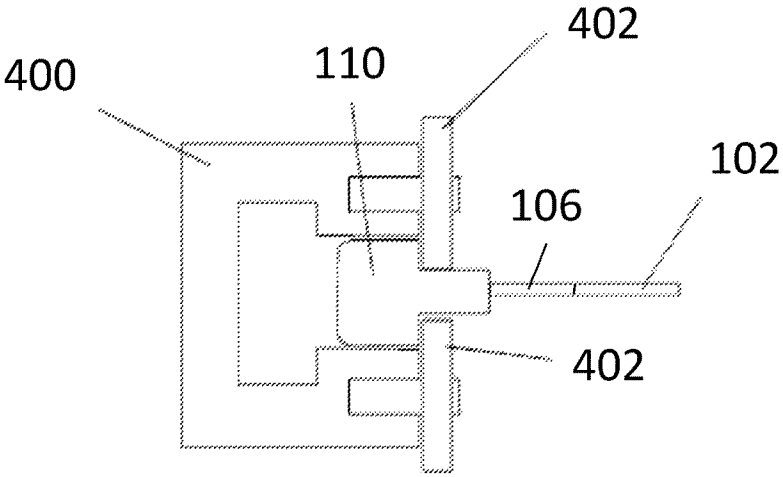
FIG. 4 is a section through a guide channel for the ITM within which the lateral formations shown in FIG. 3 are received.

The elasticity of the second portion 130 is sufficient to maintain the belt taut when the lateral formations 110 are guided through their respective guide channels 880 (FIG. 4). The elasticity of the second portion 140 allows the distance of the lateral formations 110 attached thereto to vary from the notional centerline of the belt 102 to allow the belt to be maintained under lateral tension as the belt surface moves relative to the image forming station. By maintaining the belt under lateral tension this minimizes the risk of undulations forming in the surface of the intermediate transfer medium, thereby allowing for an image to be correctly formed by the image forming station on the surface of the intermediate transfer medium.

The reduced elasticity of the first portion 130 of elongate strip 120, which is the portion of the strip connected to belt 102, results in a separation between lateral formations 110 and the belt 102. As such, when forces are applied to the lateral formations 110, these forces are absorbed by elastic second portion 140 of the elongate strip, and are dampened by the less elastic, or preferably non-elastic, first portion 130, such that the forces have little or no impact on the belt 102 or on the connection of the belt 102 to the strip 120. As such, for example, stretching of the second portion 140 to accommodate changes in the distance between the tracks guiding the lateral formations does not cause any warping or shifting of the belt 102, since such stretching stops at first portion 130.

By contrast, in the prior art, when a fully elastic strip with lateral formations is used, application of force to the strip may result also in motion of the belt due to some of the force being applied to the belt. As such, the strip 120 of the present invention reduces motion of the belt in the width-ways direction thereof, reduces warping and/or undulations forming at the edges of the belt, improves the stability of the belt, and consequently improves the registration of printing.

Additionally, as shown hereinbelow in Example 2, the maximal load at a time of failure of the connection between an elongate strip 120 and the belt 102 is significantly higher than that required to cause a failure of the connection between a fully elastic strip and the belt 102. Without wishing to be bound by theory, the Inventors believe that when using a fully elastic strip, and due to the elasticity of the strip, some of the force applied to stretching the strip is also applied to the seam or fasteners connecting the strip to the belt, thus the fact that less elastic or non-elastic portion 130 is connected to the belt 102, and the elastic portion is not directly connected to the belt, results in the force being applied to the elastic portion 140 being applied to stretching the non-elastic portion 130, and as such does not pull the strip 120 away from the belt 102.

In some embodiments, the maximal load applied to a strip 120 connected to belt 102 at a time of failure between the strip 120 and the belt 102 is at least 50 N/mm.

In some embodiments, the spring constant of the strip 120, and specifically of the second elastic portion 140 thereof, is stable under tension, and when being used and heated in a printing system, under normal printing conditions. In some such embodiments, the Reference is now made to FIG. 4, which is a section through a guide channel for the ITM 100 (or belt 810 of FIG. 1) within which the lateral formations 110 shown in FIG. 3 are received.

As seen, the lateral formations 110, disposed on strips 106 and/or 108 connected to belt 102 of ITM 100, are received in a respective guide channel 400 in order to maintain the belt taut in its width-ways dimension. The guide channels 400 and may include rolling bearing elements 402 to retain the formations 110 therewithin.

Typically, when placing the belt in the guide channels of the printing system, the lateral formations 110 on strips 106 and 108 are at substantially the same distance from a notional centerline of the belt. However, in some cases, or in some parts of the guide channel, the elastic portion 140 may be stretched more on one side of the belt than on the other side, such that the lateral formations 110 on one side of the belt are at a greater distance from the nominal centerline of the belt than the formations 110 on the other side of the belt.

The lateral formations 110 need not be the same on both lateral edges of the belt 810 or 102. They can differ in shape, spacing, composition and physical properties, as described in WO 2013/136220, the contents of which are incorporated herein by reference.

Figure 5B:
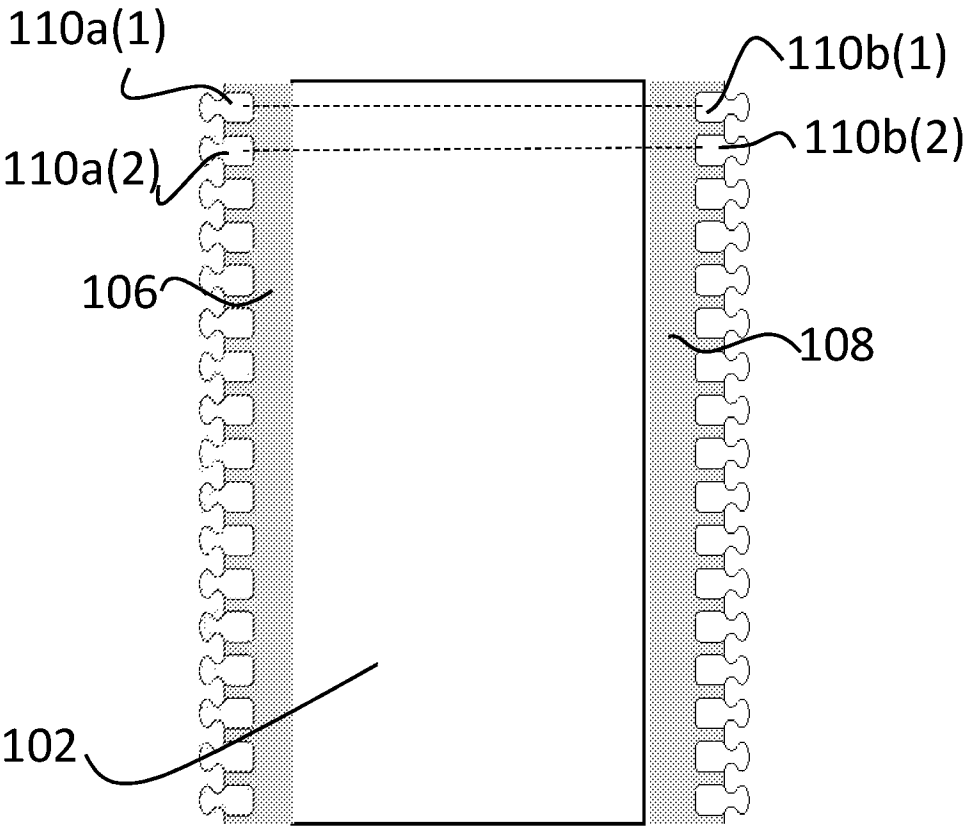
FIGS. 5A and 5B are schematic illustrations of corresponding elongate strips for both sides of the ITM, such as first and second elongate strips 106 and 108 of FIG. 2A at the time of manufacturing and when attached to a flexible belt, such as belt 102 of FIG. 2A, respectively.
Figure 5A:
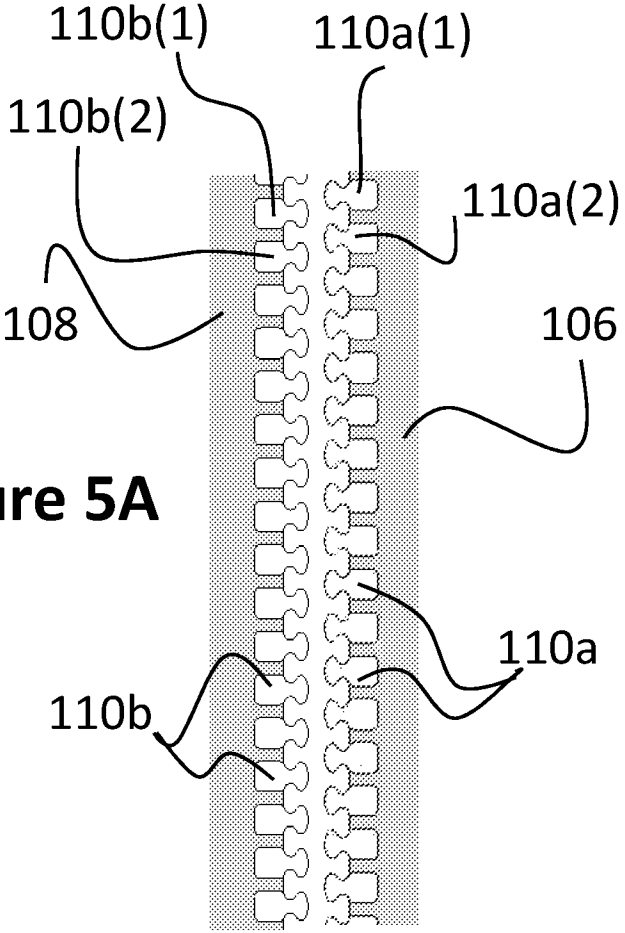

FIGS. 5A and 5B are schematic illustrations of corresponding elongate strips for both sides of the ITM, such as first and second elongate strips 106 and 108 of FIG. 2A at the time of manufacturing and when attached to a flexible belt, such as belt 102 of FIG. 2A, respectively.

As seen in FIG. 5A, the two corresponding elongate strips 106 and 108 are manufactured as two portions of a single zip fastener, which can attach to one another as in any standard zip fastener. As such, during manufacturing, the lateral formations 110*a* of elongate strip 106 are positioned corresponding to the gaps between the lateral formations 110*b* of elongate strip 108, and vice versa. Specifically, during manufacturing of the elongate strips, a first lateral formation 110*a*(1) of strip 106 is disposed above a first lateral formation 110*b*(1) of strip 108, which in turn is disposed above a second lateral formation 110*a*(2) of strip 106, beneath which is disposed a second lateral formation 110*b*(2) of strip 108. Such manufacturing of the two corresponding elongate strips 106 and 108 ensures that the elastic portions of the elongate strips are not stretched during manufacturing, thus preventing warping, curving, or undulation of the elastic portion of the strips once the lateral formations are in place. Additionally, such manufacturing of the strips ensures that the number of lateral formation, and their distribution along the strip, is identical in both sides of the belt.

Turning to FIG. 5B, it is seen that when the elongate strips 106 and 108 are attached to the flexible belt 102, the lateral formations 110*a* of elongate strip 106 and the lateral formations 110*b* of elongate strip 108 are aligned with one another, such that first lateral formation 110*a*(1) is at the same height as first lateral formation 110*b*(1), second lateral formation 110*a*(2) is at the same height as second lateral formation 110*b*(2), and so on.

EXAMPLES

Reference is now made to the following examples, which together with the above description, illustrate the invention in a non-limiting fashion.

Example 1

Analysis of Spring Constant Measurement

A strip according to the present invention as illustrated in FIG. 3, including a first portion having a first elasticity, a second portion having a second elasticity, and lateral formations, was created. The strip had a strip width S of 28.5±1 mm, a first longitudinal portion width A of 18.5±1 mm, and a second longitudinal portion width B of 10 mm.

A sample was taken from the strip, the sample having a width of 22 mm in the longitudinal direction of the strip, and was the entire width W of the strip.

The sample was placed in a Lloyd LS5 material tester, commercially available from Ametek® Inc. of Brewyn, Pa., USA using as the first grip a TG34 grip and as the second grip a portion of a guide channel taken from a printing system as described hereinabove, and a load cell of 1 kN. The TG34 grip held the second elongate portion of the sample at a distance of 10 mm from the lateral formations, and the guide channel grip held the teeth, or lateral formations, of the sample.

The tester was activated with a preload of 0.1N and with a preload stress of 10 mm/min, and was set to an extension cyclic test only. The extension rate during the test was set to 10 mm/min, and the test was repeated for 10 cycles of extending the sample and releasing it.

The spring constant of the sample was measured to be 3.0±0.5 N/mm During the test, the sample had a maximal elongation of 3 mm, or 30% elongation.

Example 2

Comparative Analysis of Failure

A first elongate strip (#1), as described hereinabove in Example 1, and a second fully elastic elongate strip (#2) having a uniform spring constant of 3.0±0.5 N/mm and lateral formations as for strip #1 were obtained. Each of the strips was adhered to an elongate flexible belt as described in PCT Application No. PCT/IB2017/053167 which is incorporated herein by reference in its entirety, by RTV734 flowable sealant commercially available from Dow Corning® of Midland, Mich., USA.

Samples were taken from each of the belts and strips, where each sample has a length of 22 mm along the longitudinal axis of the belt, and has a width of 200 mm.

Each sample was placed in a Lloyd LS5 material tester, commercially available from Ametek® Inc. of Brewyn, Pa., USA using as the first grip a chantillon grip and as the second grip a portion of a guide channel taken from a printing system as described hereinabove, and a load cell of 1 kN. The chantillon grip held the belt of the sample, and the guide channel grip held the teeth, or lateral formations, of the sample. The sample was pulled up at room temperature, until there was a failure adhesion between the belt and the strip, or until the fabric of the strip tore.

Table 1 summarizes the load used when a failure occurred (in N/mm), and the type of failure.

TABLE 1

| Sample | Maximal load [N/mm] | Failure type |
|---|---|---|
| #1 | 120 | Adhesion |
| #2 | 50 | Adhesion |

An adhesion failure occurs when the strip including the lateral formations disconnects from the belt.

As seen in Table 1, sample #1 which includes, as the elongate strip, the inventive strip described herein, was able to resist a significantly greater load than Sample #2 which includes an elastic elongate strip, as described in the prior art.

The above description is simplified and provided only for the purpose of enabling an understanding of the present invention. For a successful printing system, the physical and chemical properties of the inks, the chemical composition and possible treatment of the release surface of the belt and the control of the various stations of the printing system are all important but need not be considered in detail in the present context.

It is appreciated that an ITM as described herein, together with a suitable guiding system, may be used to form in any indirect printing system employing an ITM, as the invention herein provides a novel mechanical structure of the ITM, but does not affect the chemical properties of the ITM, or any printing-process related characteristics thereof.

The contents of all of the above mentioned applications of the Applicant are incorporated by reference as if fully set forth herein.

The present invention has been described using detailed descriptions of embodiments thereof that are provided by way of example and are not intended to limit the scope of the invention. The described embodiments comprise different features, not all of which are required in all embodiments of the invention. Some embodiments of the present invention utilize only some of the features or possible combinations of the features. Variations of embodiments of the present invention that are described and embodiments of the present invention comprising different combinations of features noted in the described embodiments will occur to persons skilled in the art to which the invention pertains.

In the description and claims of the present disclosure, each of the verbs, "comprise" "include" and "have", and conjugates thereof, are used to indicate that the object or objects of the verb are not necessarily a complete listing of members, components, elements or parts of the subject or subjects of the verb. As used herein, the singular form "a", "an" and "the" include plural references unless the context clearly dictates otherwise. For example, the term "a formation" or "at least one formation" may include a plurality of formations.

The invention claimed is:

1. An intermediate transfer member (ITM) for use in a printing system to transport ink images from an image forming station to an impression station for transfer of the ink image from the ITM onto a printing substrate, wherein the ITM comprises:

an endless flexible belt having a uniform belt width, said endless flexible belt formed of an elongate belt having a longitudinal axis;

a first elongate strip and a second elongate strip, said first and second elongate strips attached to lateral edges of said belt along said longitudinal axis, said first and second elongate strips each including lateral formations on outward facing lateral ends thereof, said outward facing lateral ends being distal to said lateral edges of said belt, wherein, during use, said belt is configured to be guided by a guiding system through at least the image forming station, said guiding system comprising guide channels configured to receive said lateral formations, wherein at least one of said first and second elongate strips has a strip width and includes a first longitudinal portion extending along said longitudinal axis and having first portion width and a first elasticity, and a second longitudinal portion extending along said longitudinal axis and having a second portion width and a second elasticity, said first portion being attached to said lateral edges of said belt and said second portion extending between said first portion and said lateral formations, wherein said second elasticity is greater than said first elasticity.

2. The ITM of claim 1, wherein said lateral formations are configured to engage said guide channels, so that said belt is placed under tension in a width-ways direction perpendicular to said longitudinal axis, and is constrained to follow a continuous path defined by said guide channels.

3. The ITM of claim 1 wherein said second portion is elastic in a width-ways direction perpendicular to said longitudinal axis.

4. The ITM of claim 1, wherein said first longitudinal portion is non-elastic, and said second longitudinal portion is elastic.

5. The ITM of claim 1, wherein only said first elongate strip includes said first portion and said second portion, and wherein said second elongate strip is non-elastic.

6. The ITM of claim 1, wherein said first elongate strip and said second elongate strip each include a said first portion and a said second portion.

7. The ITM of claim 1, wherein an elasticity of said second portion of said first elongate strip is sufficient to maintain said belt taut when said lateral formations are guided through their respective guide channels.

8. The ITM of claim 1, wherein a ratio between said second portion width and said first portion width is in the range of 1:1 to 1:15.

9. The ITM of claim 1, wherein said strip width is in the range of 20 mm to 40 mm.

10. The ITM of claim 1, wherein said first elasticity is at least 10.0, at least 20.0, at least 30.0, at least 40.0, at least 50.0 N/mm, at least 75.0, at least 100.0, at least 125.0, at least 150.0, at least 175.0, or at least 200.0 N/mm.

11. The ITM of claim 1, wherein said first elasticity is at most 5% elongation, at most 4% elongation, at most 3% elongation, at most 2% elongation, at most 1% elongation, at most 0.5% elongation, at most 0.2% elongation, or at most 0.1% elongation.

12. The ITM of claim 1, wherein said second elasticity is in the range of 0.1 to 10.0 N/mm, 0.1 to 8.0 N/mm, 0.1 to 5.0 N/mm, 1.0 to 5.0 N/mm, 2.0 to 5.0 N/mm, or 3.0 to 5.0 N/mm.

13. The ITM of claim 1, wherein said second elasticity is at least 5% elongation, at least 8% elongation, at least 10% elongation, at least 20% elongation, at least 30% elongation, at least 40% elongation, or at least 50% elongation.

14. The ITM of claim 1, wherein a ratio between spring constant measurements of said second elasticity and said first elasticity, when measured in N/mm on a sample having a sample width of 22 mm and a sample length of 10 mm, is at least 1:4, at least 1:6, at least 1:10, at least 1:12, at least 1:20, at least 1:30, at least 1:40, at least 1:50, at least 1:60, at least 1:70, at least 1:80, at least 1:90, or at least 1:100.

15. A method of forming the ITM of claim 1, the method comprising: obtaining said elongate flexible belt;

obtaining said first elongate strip including said first and second longitudinal portions;

obtaining said second elongate strip; and attaching said first and second elongate strips to said lateral edges of said elongate flexible belt.

16. A printing system comprising:

a. an intermediate transfer member (ITM) including:

(i) an endless flexible belt having a uniform belt width, said endless flexible belt formed of an elongate belt having a longitudinal axis;

(ii) a first elongate strip and a second elongate strip, each attached to lateral edges of said belt along said longitudinal axis, said first and second elongate strips each including lateral formations on outward facing lateral ends thereof, said outward facing lateral ends being distal to said lateral edges of said belt, wherein at least one of said first and second elongate strips has a strip width and includes a first longitudinal portion having a first portion width and a first elasticity, and a second longitudinal portion having a second portion width and a second elasticity, said first portion being attached to said lateral edges of said belt and said second portion extending between said first portion and said lateral formations, wherein said second elasticity is greater than said first elasticity;

b. an image forming station at which droplets of ink are applied to an outer surface of said ITM to form ink images thereon;

c. an impression station for transfer of the ink images from said ITM onto a printing substrate; and d. a guiding system comprising guide channels configured to receive said lateral formations, said guiding system extending at least through said image forming station and configured, during use, to guide said ITM along said image forming station.

17. The printing system of claim 16, wherein said second portion is elastic in a width-ways direction perpendicular to said longitudinal axis.

18. The printing system of claim 16, wherein said first longitudinal portion is non-elastic and said second longitudinal portion is elastic.

19. The printing system of 16, wherein only said first elongate strip includes said first portion and said second portion, and wherein said second elongate strip is non-elastic.

20. A method of forming a flexible belt, the method comprising:

a. obtaining an elongate flexible belt having a uniform belt width and a longitudinal axis, said belt being suitable for use as an ITM in a printing system, said elongate flexible belt having first and second lateral edges;

b. obtaining a first elongate strip having a strip width and including:

a first longitudinal portion extending along said longitudinal axis and having a first portion width and a first elasticity, said first longitudinal portion extending along said first elongate strip at a first lateral end thereof;

lateral formations on a second lateral end of said first elongate strip; and a second longitudinal portion extending along said longitudinal axis and having a second portion width and a second elasticity, said second longitudinal portion extending longitudinally between said first portion and said lateral formations, wherein said second elasticity is greater than said first elasticity;

c. obtaining a second elongate strip having first and second lateral ends, and including lateral formations on said second lateral end thereof; and d. attaching said second lateral ends of said first and second elongate strips to said first and second lateral edges of said elongate flexible belt.

* * * * *